US009291433B2

(12) United States Patent
Compton et al.

(10) Patent No.: US 9,291,433 B2
(45) Date of Patent: Mar. 22, 2016

(54) BALLISTIC-RESISTANT COMPOSITE ASSEMBLY

(75) Inventors: Stephen F. Compton, Spartanburg, SC (US); Richard M. Dayrit, Simpsonville, SC (US); William P. Roberts, Spartanburg, SC (US); Nathanael Miranda, Cary, NC (US)

(73) Assignee: Cryovac, Inc., Charlotte, NC (US)

( * ) Notice: Subject to any disclaimer, the term of this patent is extended or adjusted under 35 U.S.C. 154(b) by 251 days.

(21) Appl. No.: 13/402,226

(22) Filed: Feb. 22, 2012

(65) Prior Publication Data

US 2013/0213208 A1 Aug. 22, 2013

(51) Int. Cl.
*F41H 5/04* (2006.01)

(52) U.S. Cl.
CPC ..... *F41H 5/0478* (2013.01)

(58) Field of Classification Search
CPC . F41H 5/0471; F41H 5/0478; B32B 2571/00; B32B 2571/02; B32B 27/32
USPC ..... 442/134, 135, 286, 394
See application file for complete search history.

(56) References Cited

U.S. PATENT DOCUMENTS 4,352,926 A * 10/1982 Matsuoka et al. ..... 528/335
5,619,748 A 4/1997 Nelson et al.
5,724,670 A 3/1998 Price
5,926,842 A 7/1999 Price et al.
5,958,319 A * 9/1999 Brant ..... 264/177.19
6,119,575 A 9/2000 Dragone et al.
6,138,275 A 10/2000 Sacks
6,233,737 B1 5/2001 Ditchfield et al.
6,238,768 B1 5/2001 Van de Goot
6,319,862 B1 11/2001 Czetto, Jr.
6,846,758 B2 1/2005 Bhatnagar et al.
7,618,706 B2 11/2009 Simmelink et al.
7,629,277 B2 12/2009 Bhatnagar et al.
7,665,149 B2 2/2010 Carbajal et al.
7,799,710 B1 9/2010 Tan
8,015,617 B1 9/2011 Carbajal et al.
2003/0199215 A1 10/2003 Bhatnagar et al.
2003/0228815 A1 12/2003 Bhatnagar et al.
2005/0043460 A1 2/2005 McCormack et al.
2008/0064280 A1 3/2008 Bhatnagar et al.
2009/0068453 A1* 3/2009 Chung ..... 428/337
2010/0050310 A1 3/2010 Van Es et al.
2010/0143643 A1 6/2010 Simmelink et al.
2011/0041675 A1 2/2011 Ermalovich
2011/0203450 A1* 8/2011 Carbajal et al. ..... 89/36.02

* cited by examiner

*Primary Examiner* — Jeremy R Pierce
(74) *Attorney, Agent, or Firm* — Daniel B. Ruble

(57) ABSTRACT

A composite assembly useful for resisting the penetration of projectiles. The composite assembly comprises a plurality of ballistic fabric layers and a plurality of distinct films. The plurality of distinct films is adjacent the plurality of ballistic fabric layers. Each distinct film of the plurality of distinct films comprises thermoplastic polymer. Each distinct film of the plurality of distinct films has an elongational strength index of at least 800 psi.

23 Claims, 4 Drawing Sheets

BALLISTIC-RESISTANT COMPOSITE ASSEMBLY

The presently disclosed subject matter relates to ballistic-resistant composite assemblies useful, for example, in body armor.

BACKGROUND

Personal body armor may include a ballistic panel comprising ballistic penetration-resistant fabrics such as woven ballistic fabric comprising para-aramid yarns. In the design of a ballistic panel for personal body armor, it may be desirable to (i) increase the level of protection provided by penetration-resistance performance, (ii) decrease the weight and stiffness of the panel, and (iii) decrease the cost of the materials. However, these attributes may compete with each other, such that the designer of a ballistic panel may have to accept tradeoffs. Materials and configurations that may help the designer reduce the amount of tradeoff and provide more design options for a ballistic panel are desirable.

SUMMARY

The presently disclosed subject matter addresses one or more of the aforementioned problems.

A composite assembly useful for resisting the penetration of projectiles comprises a plurality of ballistic fabric layers and a plurality of distinct films. The plurality of distinct films is adjacent the plurality of ballistic fabric layers. Each distinct film of the plurality of distinct films comprises thermoplastic polymer. Each distinct film of the plurality of distinct films has an elongational strength index of at least 800 psi. The elongational strength index is calculated by the following formula: $ESI=(SM)^2/(ITM)$, wherein "ESI" is the elongational strength index, "SM" is the lower of the secant moduli at 125% elongation in units of psi measured in the longitudinal and transverse directions, and "ITM" is the initial tensile modulus in units of psi measured in the direction having the lower of the secant moduli at 125% elongation.

These and other objects, advantages, and features will be more readily understood and appreciated by reference to the detailed description and the drawings.

Figure 1:
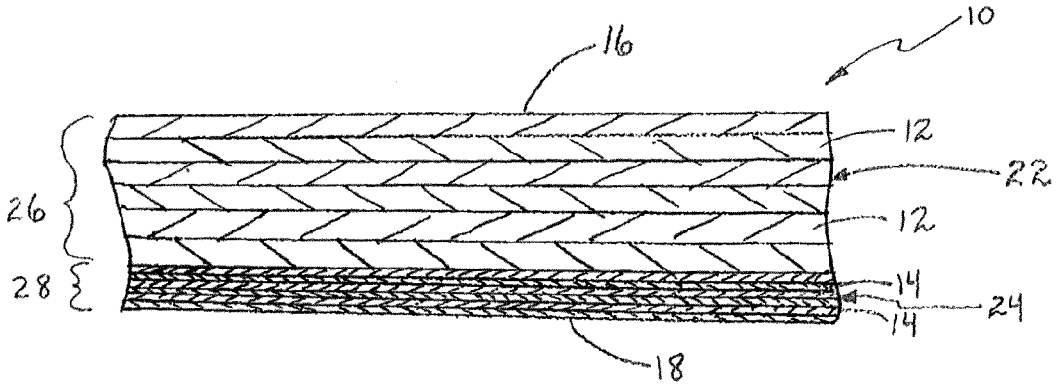
FIG. 1 is a representative partial cross-sectional side view of an embodiment of the composite assembly of the presently disclosed subject matter.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

The composite assemblies of the disclosed subject matter comprise a plurality of ballistic fabric layers and a plurality of distinct films.

I. Ballistic Fabric Layers

In embodiments of the disclosed subject matter, a composite assembly comprises a plurality 22 of ballistic fabric layers 12 each comprising ballistic fabric. (FIGS. 1-7.)

The term "fabric" as used herein refers to a flexible material comprising yarn, for example, where (1) the yarn may be woven, knitted, spread, crocheted, or bonded to form the material, and/or (2) the yarn may be otherwise consolidated into sheets for example by a combination of heat and pressure to form the material. A fabric is typically used in the production of further goods.

The term "ballistic fabric" as used herein refers to a fabric comprising at least 50% by the weight of the fabric of yarns having a tenacity of at least 7 grams/denier and an initial tensile modulus of at least 100 grams/denier. Ballistic fabrics are incorporated in a good, typically as multiple layers, to enhance the ballistic-resistance performance of the good. The ballistic fabric may comprise one or more of any of the yarns described herein.

A "yarn" is a continuous strand comprising a plurality of filaments or fibers. The art and technology of yarn manufacture from filaments (i.e., fibers) is known to those of skill in the art; see, for example, U.S. Pat. No. 8,015,617 to Carbajal et al, which is incorporated herein in its entirety by reference. The yarns of the ballistic fabric may comprise one or more types of fibers in essentially parallel alignment, or the yarn fibers may be twisted, over-wrapped, or entangled, for example as disclosed in U.S. Pat. No. 5,773,370, which is incorporated herein in its entirety by reference.

A "fiber" is an elongate body the length dimension of which is much greater than the transverse dimensions of width and thickness, and includes filaments, ribbon, strip, and the like having regular or irregular cross-section. The majority of fibers of the ballistic fabric may be, for example, at least any of 0.4, 0.8, and 1 denier; and/or at most any of 20, 12, and 15 denier.

The ballistic fabric may comprise, for example by any one of at least 50%, 60%, 70%, and 80% by weight of the ballistic fabric, of one or more yarns having any of one or more of the following characteristics (measured as the average of the yarns of the fabric). The yarns may have yarn tenacity (i.e., breaking tenacity) of at least any of 7, 8, 10, 11, 15, 16, 20, 22, 25, 28, and 30 grams per denier; and/or at most any of 65 and 50 g/d. The yarns may have an initial tensile modulus of at least any of 100, 150, 200, 300, 400, 500, 900, 1000, and 1200 grams per denier; and/or at most any of 2700 and 2200 g/d. The yarns may have a linear mass density of at least any of 50, 200, 650, and 800 denier; and/or at most any of 4500, 3500, 3000, 1500, 1300, and 800 denier. The yarns may have an elongation to break of at least any of 1 and 1.5%; and/or at most any of 8 and 5% percent. The yarns may have an energy to break of at least any of 8, 20, 27, and 40 J/g. The tenacity, initial tensile modulus, and energy-to break of the yarns are measured according to ASTM D2256. The linear density of the yarns are measured according to ASTM 885 and ASTM D1907.

The ballistic fabric may have an areal density of at least any of 50, 100, and 130 g/m2; and/or at most any of 800, 600, and 500 g/m2. The areal density is determined by measuring the weight of a single ply or layer of material for a selected area (e.g., 10 cm×10 cm). The areal density of a composite of fabrics may be determined by the sum of the areal densities of the individual plies.

A. Yarn Composition

The ballistic fabric may comprise yarns comprising fibers comprising material that produces high-strength fibers suitable for use in ballistic fabrics. Accordingly, yarns and fibers of the ballistic fabric may comprise one or more of any of the following materials: polyamide, polyolefin, polyvinyl alcohol, polyacrylonitrile, liquid crystal copolyester, glass, carbon fibers, and polyazole, as described herein.

Useful polyamide that produces high-strength fiber is aramid. Accordingly, the ballistic fabric may comprise yarn comprising aramid. As used herein, "aramid" refers to a polyamide having at least 85 mole % of the amide (—CONH—) linkages attached directly to two aromatic rings. Aramid-based fiber and its production are known in the art, for example, as disclosed in U.S. Pat. Nos. 3,094,511; 3,354,127; 3,671,542; 3,673,143; 3,767,756; 3,819,587; 3,869,429; 3,869,430; and 4,172,938; each of which is incorporated herein in its entirety by reference.

A useful aramid is para-aramid, such as poly(p-phenylene terephthalamide), known as "PPD-T." PPD-T is a homopolymer resulting from mole-for-mole polymerization of p-phenylene diamine and terephthaloyl chloride, and includes copolymers resulting from incorporation of small amounts of other diamines with the p-phenylene diamine and of small amounts of other diacid chlorides with the terephthaloyl chloride. Fibers and yarns comprising PPD-T aramid are available from Dupont under the Kevlar trade name, for example as Kevlar 29 yarn (believed to have a tenacity of 23.0 g/d and an initial tensile modulus of 555 g/d) and Kevlar 49 (believed to have a tenacity of 23.6 g/d and an initial tensile modulus of 885 g/d), as well as from Teijen Armaid under the Twaron trade name. Fibers and yarns comprising poly(m-phenylene isophthalamide) are available from Dupont under the Nomex trade name.

Additives and/or other polymeric material may be blended with the aramid (e.g., up to 10% by weight), as is known in the art.

Useful polyolefin that produces high-strength fiber includes high molecular weight polyolefin (e.g., polyethylene and/or polypropylene) having the molecular weights recited herein. Useful high molecular weight polyethylene includes ultra high molecular weight polyethylene (UHMWPE) or extended chain polyethylene (ECPE). Accordingly, the ballistic fabric may comprise yarn comprising UHMWPE or ECPE. Ultra high molecular weight polyethylene comprises extremely long chains of polyethylene which may be formed into fibers to attain significant parallel orientation. UHMWPE fibers may be formed by gel spinning (extruded through a spinneret) so that the resulting fiber has a high degree of molecular orientation and tensile strength. UHMWPE may have polyethylene molecules comprising from 100,000 to 250,000 ethylene monomers each. The high molecular weight polyethylene (e.g., UHMWPE) may have, for example, a weight average molecular weight of at least any of 150,000; one million; and two million; and/or at most 5 million. Such high molecular weight polyethylene may contain minor amounts of chain branching or comonomers not exceeding, for example, 5 modifying units per 100 main chain carbon atoms, and may also contain not more than 50 weight percent of one or more polymeric additives such as alkene-1-polymers, low density polyethylene, propylene, and the like, or low molecular weight additives such as anti-oxidants, lubricants, ultra-violet screening agents, and colorants. The manufacture of fibers from such polyethylene is described, for example, in U.S. Pat. Nos. 5,702,657; 4,457,985; 4,478,083; 4,413,110; 4,356,138; 4,276,348; 4,228,118; and 4,137,394, each of which is incorporated herein in its entirety by reference. Yarns and fibers comprising high molecular weight olefin (e.g., UHMWPE or ECPE) are commercially available, for example, from Honeywell Advanced Fibers and Composites under the Spectra trade name (e.g., Spectra fiber 900 and Spectra fiber 1000) and from DSM under the Dyneema trade name.

Useful high molecular weight polypropylene may have a weight average molecular weight of at least any of 200,000; one million; and two million. Such extended chain polypropylene may be formed into reasonably well oriented filaments by the techniques described in the references incorporated above (e.g., U.S. Pat. No. 4,413,110). Since polypropylene is a much less crystalline material than polyethylene and contains pendant methyl groups, tenacity values achievable with polypropylene are generally on the lower end of the tenacity values previously recited.

Useful polymer that produces high-strength fiber includes high molecular weight polyvinyl alcohol (PV—OH), for example, having a weight average molecular weight of at least 200,000. High molecular weight PV—OH, fibers comprising same, and methods of production are described, for example, in U.S. Pat. Nos. 4,440,711 and 4,599,267, each of which is incorporated herein in its entirety by reference.

Useful polyacrylonitrile ("PAN") that produces high-strength fiber includes high molecular weight PAN, for example, having a weight average molecular weight of at least 400,000. Fibers comprising PAN are described in U.S. Pat. No. 4,535,027, which is incorporated herein in its entirety by reference.

Useful polyazoles that produce high-strength fiber include polyarenazoles such as polybenzazoles and polypyridazoles. Suitable polyazoles include homopolymers and/or copolymers. Additives may be used with the polyazoles and up to as much as 10 percent, by weight, of other polymeric material can be blended with the polyazoles. Also copolymers can be used having as much as 10 percent or more of other monomer substituted for a monomer of the polyazoles. Useful polyazole homopolymers and copolymers are made by known procedures; see, for example, U.S. Pat. Nos. 4,533,693; 4,703,103; 5,089,591; 4,772,678; 4,847,350; and 5,276,128, each of which is incorporated herein in its entirety by reference.

Useful polybenzazoles that produce high-strength fiber include polybenzimidazoles, polybenzothiazoles (e.g., poly (p-phenylene benzobisthiazole)), and polybenzoxazoles (e.g., poly(p-phenylene benzobisoxazole) and poly(p-phenylene-2,6-benzobisoxazole) ("PBO")). Fibers comprising polybenzazoles are described, for example, in U.S. Pat. Nos. 5,286,833; 5,296,185; 5,356,584; 5,534,205; and 6,040,050. Polybenzazole fibers are available from Toyobo Co under the ZYLON trade name.

Useful polypyridazoles that produce high-strength fiber include polypyridimidazoles, polypyridothiazoles, and polypyridoxazoles. These include, for example, polypyridobisazole and poly(pyridobisozazole) such as poly(1,4-(2,5-dihydroxy)phenylene-2,6-pyrido[2,3-d:5,6-d']bisimidazole ("PIPD"). Useful polypyridazoles, including polypyridobisazoles, are described in U.S. Pat. No. 5,674,969, which is incorporated herein in its entirety by reference.

Useful liquid crystal copolyester that produces high-strength fibers are described, for example, in U.S. Pat. Nos. 3,975,487; 4,118,372; and 4,161,470, each of which is incorporated herein in its entirety by reference.

B. Fabric Configuration—Woven

The ballistic fabric may be a woven ballistic fabric, for example, woven from one or more of the high-strength yarns described herein. A woven fabric comprises at least two yarns (e.g., warp yarns and weft yarns) interlaced or interwoven, typically at right angles. The woven fabric may have any of a plain weave, crowfoot weave, basket weave, satin weave, twill weave, or unbalanced weave. The fabric may be woven with yarns having different fibers in the warp and weft directions, or in other directions.

The woven ballistic fabric warp yarn count (number of warp yarns per unit length) of each ballistic fabric layer 12 may be at least any of 5, 8, and 10 ends per inch (2, 3, and 4 ends per centimeter); and/or at most any of 100, 60, and 45 ends per inch (39, 24, and 18 ends per centimeter). The woven ballistic fabric weft yarn count (number of weft or fill yarns per unit length) of each ballistic fabric layer 12 may be at least any of 5, 8, and 10 picks per inch (2, 3, and 4 picks per centimeter); and/or at most any of 100, 60, and 45 picks per inch (39, 24, and 18 picks per centimeter).

Each woven ballistic fabric layer may be free of a matrix resin coating (e.g., resin encasement) in which the yarn is embedded.

The woven ballistic fabric layer may comprise any weave pattern, including plain weave, twill, satin, three dimensional woven fabrics, and any of their several variations. Plain weave fabrics may have an equal warp and weft count.

C. Fabric Configuration—Consolidated

The ballistic fabric may be a consolidated ballistic fabric, that is, one comprising one or more of the high-strength yarns described herein that have been arranged other than by weaving. For example, the yarns may be arrayed in a generally parallel, side-by-side configuration in a plane and held in place (i.e., encased) by a matrix resin system to create a unidirectional tape. Two or more of these unidirectional tapes may be assembled in a stacked arrangement having the direction of the alignment of the yarns alternating or cross-plied at an angle (typically at right angles or alternating 0°/90° orientation) with respect to the alignment of the yarns in the adjacent tape. The stack may be fused under heat and pressure to form a consolidated ballistic fabric. Consolidated ballistic fabrics are described, for example, in U.S. Pat. No. 5,160,776 to Li et al, which is incorporated herein in its entirety by reference. Such consolidated ballistic fabrics are available from Honeywell Advanced Fibers and Composites under the Spectra Shield trade name (incorporating yarns comprising extended chain polyethylene) and under the Gold Shield and Gold Flex trade names (incorporating yarns comprising aramid).

II. Distinct Films

In embodiments of the disclosed subject matter, a composite assembly comprises a plurality 24 of distinct films 14. (FIGS. 1-7.) A "distinct" film is a film that is not adhered (by heat or adhesive bonding) to another film by more than 80% of its surface area. Accordingly, a component layer of a multi-layered coextruded film is not itself a distinct film. Also by way of example, two films that are adhesively laminated together by more than 80% of the coextensive area are considered one "distinct" film. The term "layer" in reference to a layer of a film (as in a component layer of a multi-layer film) refers to a discrete film component which is substantially coextensive with the film and has a substantially uniform composition. Where two or more directly adjacent layers of a film have essentially the same composition, then these two or more adjacent layers may be considered a single layer for the purposes of this application.

The distinct film may comprise one or more thermoplastic polymers, for example, at least any of 50%, 60%, 70%, 80%, and 90% by weight of the distinct film of any one or more of polyolefin (e.g., polyethylene, polypropylene), ethylene/vinyl alcohol copolymer, ionomer, vinyl plastic (e.g., polyvinyl chloride, polyvinylidene chloride), polyamide, and polyester. The distinct film, or any of the layers of the distinct film (e.g., any of the layers of the film discussed below), may comprise at least, and/or at most, any of polymers discussed below in any of the following weight percent values: 50, 55, 60, 65, 70, 75, 80, 85, 90, 95, 97, 99 and 100% by weight of the distinct film or by weight of the layer of the distinct film.

A. Polyolefin

The distinct film may comprise polyolefin. Useful polyolefin includes ethylene homo- and co-polymers and propylene homo- and co-polymers. The term "polyolefin" includes copolymers that contain at least 50 weight % monomer units derived from olefin. Ethylene homopolymers include high density polyethylene ("HDPE") and low density polyethylene ("LDPE"). Ethylene copolymers include ethylene/alpha-olefin copolymers ("EAOs"), ethylene/unsaturated ester copolymers, and ethylene/(meth)acrylic acid. ("Copolymer" as used in this application means a polymer derived from two or more types of monomers, and includes terpolymers, etc.)

EAOs are copolymers of ethylene and one or more alpha-olefins, the copolymer having ethylene as the majority mole-percentage content. The comonomer may include one or more $C_3$-$C_{20}$ α-olefins, one or more $C_4$-$C_{12}$ α-olefins, and one or more $C_4$-$C_8$ α-olefins. Useful α-olefins include 1-butene, 1-hexene, 1-octene, and mixtures thereof.

EAOs include one or more of the following: 1) medium density polyethylene ("MDPE"), for example having a density of from 0.926 to 0.94 g/cm3; 2) linear medium density polyethylene ("LMDPE"), for example having a density of from 0.926 to 0.94 g/cm3; 3) linear low density polyethylene ("LLDPE"), for example having a density of from 0.915 to 0.930 g/cm3; 4) very-low or ultra-low density polyethylene ("VLDPE" and "ULDPE"), for example having density below 0.915 g/cm3, and 5) homogeneous EAOs. Useful EAOs include those having a density of less than any of the following: 0.925, 0.922, 0.92, 0.917, 0.915, 0.912, 0.91, 0.907, 0.905, 0.903, 0.9, and 0.898 grams/cubic centimeter. Unless otherwise indicated, all thermoplastic polymer densities herein are measured according to ASTM D1505.

The polyethylene polymers may be either heterogeneous or homogeneous. As is known in the art, heterogeneous polymers have a relatively wide variation in molecular weight and composition distribution. Heterogeneous polymers may be prepared with, for example, conventional Ziegler-Natta catalysts.

On the other hand, homogeneous polymers are typically prepared using metallocene or other single-site catalysts. Such single-site catalysts typically have only one type of catalytic site, which is believed to be the basis for the homogeneity of the polymers resulting from the polymerization. Homogeneous polymers are structurally different from heterogeneous polymers in that homogeneous polymers exhibit a relatively even sequencing of comonomers within a chain, a mirroring of sequence distribution in all chains, and a similarity of length of all chains. As a result, homogeneous polymers have relatively narrow molecular weight and composition distributions. Examples of homogeneous polymers include the metallocene-catalyzed linear homogeneous ethylene/alpha-olefin copolymer resins available from the Exxon Chemical Company (Baytown, Tex.) under the EXACT trademark, linear homogeneous ethylene/alpha-olefin copolymer resins available from the Mitsui Petrochemical Corporation under the TAFMER trademark, and long-chain branched, metallocene-catalyzed homogeneous ethylene/alpha-olefin copolymer resins available from the Dow Chemical Company under the AFFINITY trademark.

Another useful ethylene copolymer is ethylene/unsaturated ester copolymer, which is the copolymer of ethylene and one or more unsaturated ester monomers. Useful unsaturated esters include: 1) vinyl esters of aliphatic carboxylic acids, where the esters have from 4 to 12 carbon atoms, and 2) alkyl esters of acrylic or methacrylic acid (collectively, "alkyl (meth)acrylate"), where the esters have from 4 to 12 carbon atoms.

Representative examples of the first ("vinyl ester") group of monomers include vinyl acetate, vinyl propionate, vinyl hexanoate, and vinyl 2-ethylhexanoate. The vinyl ester monomer may have from 4 to 8 carbon atoms, from 4 to 6 carbon atoms, from 4 to 5 carbon atoms, and preferably 4 carbon atoms.

Representative examples of the second ("alkyl (meth)acrylate") group of monomers include methyl acrylate, ethyl acrylate, isobutyl acrylate, n-butyl acrylate, hexyl acrylate, and 2-ethylhexyl acrylate, methyl methacrylate, ethyl methacrylate, isobutyl methacrylate, n-butyl methacrylate, hexyl methacrylate, and 2-ethylhexyl methacrylate. The alkyl (meth)acrylate monomer may have from 4 to 8 carbon atoms, from 4 to 6 carbon atoms, and preferably from 4 to 5 carbon atoms.

The unsaturated ester (i.e., vinyl ester or alkyl (meth)acrylate) comonomer content of the ethylene/unsaturated ester copolymer may range from 6 to 18 weight %, and from 8 to 12 weight %, based on the weight of the copolymer. Useful ethylene contents of the ethylene/unsaturated ester copolymer include the following amounts: at least 82 weight %, at least 85 weight %, at least 88 weight %, no greater than 94 weight %, no greater than 93 weight %, and no greater than 92 weight %, based on the weight of the copolymer.

Representative examples of ethylene/unsaturated ester copolymers include ethylene/methyl acrylate, ethylene/methyl methacrylate, ethylene/ethyl acrylate, ethylene/ethyl methacrylate, ethylene/butyl acrylate, ethylene/2-ethylhexyl methacrylate, and ethylene/vinyl acetate.

Another useful ethylene copolymer is ethylene/(meth) acrylic acid, which is the copolymer of ethylene and acrylic acid, methacrylic acid, or both.

The distinct film may comprise propylene copolymer. Propylene copolymer includes propylene/ethylene copolymers ("PEC"), which are copolymers of propylene and ethylene having a majority weight % propylene monomer content. Useful PEC may have an ethylene monomer content of at least, and/or at most, any of the following: 2, 3, 4, 5, 6, 8, 10, 12, and 15 weight percent. Useful PEC may have a density of at least, and/or at most, any of the following: 0.900, 0.092, and 0.905 g/cc. Useful PEC may have a melting point of at least, and/or at most, any of the following: 130, 135, 140, 145, and 150° C. The PEC may comprise at least, and/or at most, 80%, 90%, 95%, and 100% random PEC, based on the total weight of PEC in the discrete film. The PEC may be selected from heterogeneous PEC or homogeneous PEC. Heterogeneous polymers have a relatively wide variation in molecular weight and composition distribution. Heterogeneous polymers may be prepared with, for example, conventional Ziegler-Natta catalysts. On the other hand, homogeneous polymers have relatively narrow molecular weight and composition distributions, and are typically prepared using single-site catalysts such as metallocene. The distinction between heterogeneous and homogenous polymers are discussed herein in more detail.

B. EVOH

The distinct film may comprise ethylene/vinyl alcohol copolymer ("EVOH"). EVOH may have an ethylene content of at least any of the following values: 20%, 25%, 30%, and 32% by weight. EVOH may have an ethylene content of at most any of the following values: 40%, 35%, and 33% by weight. EVOH may include saponified or hydrolyzed ethylene/vinyl acetate copolymers, such as those having a degree of hydrolysis of at least any of the following values: 50% and 85%.

C. Ionomer

The distinct film may comprise ionomer, which is a copolymer of ethylene and an ethylenically unsaturated monocarboxylic acid having the carboxylic acid groups partially neutralized by a metal ion, such as sodium or zinc. Useful ionomers include those in which sufficient metal ion is present to neutralize from 10% to 60% of the acid groups in the ionomer. The carboxylic acid is preferably "(meth)acrylic acid"—which means acrylic acid and/or methacrylic acid. Useful ionomers include those having at least 50 weight % and preferably at least 80 weight % ethylene units. Useful ionomers also include those having from 1 to 20 weight percent acid units. Useful ionomers are available, for example, from Dupont Corporation (Wilmington, Del.) under the SURLYN trademark.

D. Vinyl Plastic

The distinct film may comprise vinyl plastic. Vinyl plastics include polyvinyl chloride ("PVC"), vinylidene chloride polymer ("PVdC"), and polyvinyl alcohol ("PVOH"). Polyvinyl chloride ("PVC") refers to a vinyl chloride-containing polymer or copolymer—that is, a polymer that includes at least 50 weight percent monomer units derived from vinyl chloride ($CH_2{=}CHCl$) and also, optionally, one or more comonomer units, for example, derived from vinyl acetate. One or more plasticizers may be compounded with PVC to soften the resin and/or enhance flexibility and processability. Useful plasticizers for this purpose are known in the art.

Another exemplary vinyl plastic is vinylidene chloride polymer ("PVdC"), which refers to a vinylidene chloride-containing polymer or copolymer—that is, a polymer that includes monomer units derived from vinylidene chloride ($CH_2{=}CCl_2$) and also, optionally, monomer units derived from one or more of vinyl chloride, styrene, vinyl acetate, acrylonitrile, and $C_1$ to $C_{12}$ alkyl esters of (meth)acrylic acid (e.g., methyl acrylate, butyl acrylate, methyl methacrylate). As used herein, "(meth)acrylic acid" refers to both acrylic acid and/or methacrylic acid; and "(meth)acrylate" refers to both acrylate and methacrylate. Examples of PVdC include one or more of the following: vinylidene chloride homopolymer, vinylidene chloride/vinyl chloride copolymer ("VDC/VC"), vinylidene chloride/methyl acrylate copolymer, vinylidene chloride/ethyl acrylate copolymer, vinylidene chloride/ethyl methacrylate copolymer, vinylidene chloride/methyl methacrylate copolymer, vinylidene chloride/butyl acrylate copolymer, vinylidene chloride/styrene copolymer, vinylidene chloride/acrylonitrile copolymer, and vinylidene chloride/vinyl acetate copolymer.

Useful PVdC includes that having at least 75%, at most 95%, and at most 98 weight % vinylidene chloride monomer. Useful PVdC (for example, as applied by latex emulsion coating) includes that having at least any of 5%, 10%, and 15%—and/or at most any of 25%, 22%, 20%, and 15 weight %—comonomer with the vinylidene chloride monomer.

Useful PVdC includes that having a weight-average molecular weight ($M_W$) of at least any of the following 10,000; 50,000; 80,000; 90,000; 100,000; 111,000; 120,000; 150,000; and 180,000; and at most any of the following: 180,000, 170,000; 160,000; 150,000; 140,000; 100,000; and 50,000. Useful PVdC also includes that having a viscosity-average molecular weight ($M_Z$) of at least any of the following: 130,000; 150,000; 170,000; 200,000; 250,000; and 300,000; and at most any of the following: 300,000; 270,000; 250,000; and 240,000.

A layer that includes PVdC may also include a thermal stabilizer (e.g., a hydrogen chloride scavenger such as epoxidized soybean oil) and a lubricating processing aid (e.g., one or more acrylates).

E. Polyamide

The distinct film may comprise polyamide. Useful polyamides include those of the type that may be formed by the polycondensation of one or more diamines with one or more diacids and/or of the type that may be formed by the polycondensation of one or more amino acids. Useful polyamides include aliphatic polyamides and aliphatic/aromatic polyamides.

Representative aliphatic diamines for making polyamides include those having the formula:

$$H_2N(CH_2)_nNH_2$$

where n has an integer value of 1 to 16. Representative examples include trimethylenediamine, tetramethylenediamine, pentamethylenediamine, hexamethylenediamine, octamethylenediamine, decamethylenediamine, dodecamethylenediamine, hexadecamethylenediamine. Representative aromatic diamines include p-phenylenediamine, 4,4'-diaminodiphenyl ether, 4,4' diaminodiphenyl sulphone, 4,4'-diaminodiphenylethane. Representative alkylated diamines include 2,2-dimethylpentamethylenediamine, 2,2,4-trimethylhexamethylenediamine, and 2,4,4 trimethylpentamethylenediamine. Representative cycloaliphatic diamines include diaminodicyclohexylmethane. Other useful diamines include heptamethylenediamine, nonamethylenediamine, and the like.

Representative diacids for making polyamides include dicarboxylic acids, which may be represented by the general formula:

HOOC—Z—COOH where Z is representative of a divalent aliphatic or cyclic radical containing at least 2 carbon atoms. Representative examples include aliphatic dicarboxylic acids, such as adipic acid, sebacic acid, octadecanedioic acid, pimelic acid, suberic acid, azelaic acid, dodecanedioic acid, and glutaric acid; and aromatic dicarboxylic acids, such as such as isophthalic acid and terephthalic acid.

The polycondensation reaction product of one or more or the above diamines with one or more of the above diacids may form useful polyamides. Representative polyamides of the type that may be formed by the polycondensation of one or more diamines with one or more diacids include aliphatic polyamides such as poly(hexamethylene adipamide) ("nylon-6,6"), poly(hexamethylene sebacamide) ("nylon-6,10"), poly(heptamethylene pimelamide) ("nylon-7,7"), poly(octamethylene suberamide) ("nylon-8,8"), poly(hexamethylene azelamide) ("nylon-6,9"), poly(nonamethylene azelamide) ("nylon-9,9"), poly(decamethylene azelamide) ("nylon-10,9"), poly(tetramethylenediamine-co-oxalic acid) ("nylon-4,2"), the polyamide of n-dodecanedioic acid and hexamethylenediamine ("nylon-6,12"), the polyamide of dodecamethylenediamine and n-dodecanedioic acid ("nylon-12,12").

Representative aliphatic/aromatic polyamides include poly(tetramethylenediamine-co-isophthalic acid) ("nylon-4,I"), polyhexamethylene isophthalamide ("nylon-6,I"), polyhexamethylene terephthalamide ("nylon-6,T"), poly (2,2,2-trimethyl hexamethylene terephthalamide), poly(m-xylylene adipamide) ("nylon-MXD,6"), poly(p-xylylene adipamide), poly(hexamethylene terephthalamide), poly(dodecamethylene terephthalamide), and polyamide-MXD,I.

Representative polyamides of the type that may be formed by the polycondensation of one or more amino acids include poly(4-aminobutyric acid) ("nylon-4"), poly(6-aminohexanoic acid) ("nylon-6" or "poly(caprolactam)"), poly(7-aminoheptanoic acid) ("nylon-7"), poly(8-aminooctanoic acid) ("nylon-8"), poly(9-aminononanoic acid) ("nylon-9"), poly (10-aminodecanoic acid) ("nylon-10"), poly(11-aminoundecanoic acid) ("nylon-11"), and poly(12-aminododecanoic acid) ("nylon-12").

Representative copolyamides include copolymers based on a combination of the monomers used to make any of the foregoing polyamides, such as, nylon-4/6, nylon-6/6, nylon-6/9, nylon-6/12, caprolactam/hexamethylene adipamide copolymer ("nylon-6,6/6"), hexamethylene adipamide/caprolactam copolymer ("nylon-6/6,6"), trimethylene adipamide/hexamethylene azelaiamide copolymer ("nylon-trimethyl 6,2/6,2"), hexamethylene adipamide-hexamethylene-azelaiamide caprolactam copolymer ("nylon-6,6/6,9/6"), hexamethylene adipamide/hexamethylene-isophthalamide ("nylon-6,6/6,I"), hexamethylene adipamide/hexamethyleneterephthalamide ("nylon-6,6/6,T"), nylon-6,T/6,I, nylon-6/MXD,T/MXD,I, nylon-6,6/6,10, and nylon-6,I/6,T.

Conventional nomenclature typically lists the major constituent of a copolymer before the slash ("/") in the name of a copolymer; however, in this application the constituent listed before the slash is not necessarily the major constituent unless specifically identified as such. For example, unless the application specifically notes to the contrary, "nylon-6/6,6" and "nylon-6,6/6" may be considered as referring to the same type of copolyamide.

Polyamide copolymers may include the most prevalent polymer unit in the copolymer (e.g., hexamethylene adipamide as a polymer unit in the copolymer nylon-6,6/6) in mole percentages ranging from any of the following: at least 50%, at least 60%, at least 70%, at least 80%, and at least 90%, and the ranges between any of the forgoing values (e.g., from 60 to 80%); and may include the second most prevalent polymer unit in the copolymer (e.g., caprolactam as a polymer unit in the copolymer nylon-6,6/6) in mole percentages ranging from any of the following: less than 50%, less than 40%, less than 30%, less than 20%, less than 10%, and the ranges between any of the forgoing values (e.g., from 20 to 40%).

F. Polyester

The distinct film may comprise polyester. Useful polyesters include those made by: 1) condensation of polyfunctional carboxylic acids with polyfunctional alcohols, 2) polycondensation of hydroxycarboxylic acid, and 3) polymerization of cyclic esters (e.g., lactone).

Exemplary polyfunctional carboxylic acids (and their derivatives such as anhydrides or simple esters like methyl esters) include aromatic dicarboxylic acids and derivatives (e.g., terephthalic acid, isophthalic acid, dimethyl terephthalate, dimethyl isophthalate) and aliphatic dicarboxylic acids and derivatives (e.g., adipic acid, azelaic acid, sebacic acid, oxalic acid, succinic acid, glutaric acid, dodecanoic diacid, 1,4-cyclohexane dicarboxylic acid, dimethyl-1,4-cyclohexane dicarboxylate ester, dimethyl adipate). Useful dicarboxylic acids also include those discussed above in the polyamide section. As is known to those of skill in the art, polyesters may be produced using anhydrides and esters of polyfunctional carboxylic acids.

Exemplary polyfunctional alcohols include dihydric alcohols (and bisphenols) such as ethylene glycol, 1,2-propanediol, 1,3-propanediol, 1,3 butanediol, 1,4-butanediol, 1,4-cyclohexanedimethanol, 2,2-dimethyl-1,3-propanediol, 1,6-hexanediol, poly(tetrahydroxy-1,1'-biphenyl, 1,4-hydroquinone, and bisphenol A.

Exemplary hydroxycarboxylic acids and lactones include 4-hydroxybenzoic acid, 6-hydroxy-2-naphthoic acid, pivalolactone, and caprolactone.

Useful polyesters include homopolymers and copolymers. These may be derived from one or more of the constituents discussed above. Exemplary polyesters include poly(ethylene terephthalate) ("PET"), poly(butylene terephthalate) ("PBT"), and poly(ethylene naphthalate) ("PEN"). If the polyester includes a mer unit derived from terephthalic acid, then such mer content (mole %) of the diacid of the polyester may be at least any the following: 70, 75, 80, 85, 90, and 95%.

The polyester may be thermoplastic. The polyester (e.g., copolyester) of the distinct film may be amorphous, or may be partially crystalline (semi-crystalline), such as with a crystallinity of at least about, or at most about, any of the following weight percentages: 10, 15, 20, 25, 30, 35, 40, and 50%.

III. Distinct Film Attributes

The distinct film may have any total thickness as long as the distinct film has the desired properties as described herein. The distinct film may have a thickness of at most any of the following: 30 mils, 20 mils, 10 mils, 5 mils, 4 mils, 3 mils, 2 mils, 1.5 mils, 1.2 mils, and 1 mil. The distinct film may also have a thickness of at least any of the following: 0.25 mils, 0.3 mils, 0.35 mils, 0.4 mils, 0.45 mils, 0.5 mils, 0.6 mils, 0.75 mils, 0.8 mils, 0.9 mils, 1 mil, 1.2 mils, 1.4 mils, 1.5 mils, 2 mils, 3 mils, and 5 mils.

The distinct film may be monolayer or multilayer. The distinct film may comprise at least, and/or at most, any of the following numbers of layers: 1, 2, 3, 4, 5, 6, 7, 8, 9, 10, 11, 13, and 15. Any of the layers of the distinct film may have a thickness of at least any of the following: 0.05, 0.1, 0.2, 0.5, 1, 2, and 3 mil. Any of the layers of the distinct film may have a thickness of at most any of the following: 5, 2, 1, and 0.5 mils. Any of the layers of the distinct film may have a thickness as a percentage of the total thickness of the distinct film of at least any of the following values: 1,3, 5, 7, 10, 15, 20, 30, 40, 50, 60, 70, 80, and 90%. Any of the layers of the distinct film may have a thickness as a percentage of the total thickness of the distinct film of at most any of the following values: 90, 80, 50, 40, 35, 30, 25, 20, 15, 10, and 5%.

One or more layers of the distinct film may include one or more additives useful in thermoplastic films, such as, antiblocking agents, slip agents, colorants, pigments, dyes, antimicrobial agents, antioxidants, fillers, radiation stabilizers, and antistatic agents. Such additives, and their effective amounts, are known in the art.

Each distinct film of the plurality of distinct films may have an elongational strength index ("ESI") of at least any of 800, 850, 900, 950, 1000, 1050, 1100, 1150, 1200, 1250, 1300, 1350, 1400, 1450, and 1500 psi; and/or at most any of 5,000 and 4,000 psi. The ESI is calculated by dividing the square of the secant modulus at 125% elongation (expressed in psi) by the initial tensile modulus (expressed in psi), where the secant modulus at 125% elongation is the lower of the secant moduli at 125% elongation in the longitudinal (machine) and the transverse directions, and the initial tensile modulus is in the same direction as the secant modulus at 125% elongation. This calculation may be represented by the following formula:

$$ESI=(SM)^2/(ITM)$$

wherein ESI is the elongational strength index in units of psi, SM is the lower of the secant moduli at 125% elongation in units of psi measured in the longitudinal and transverse directions, and ITM is the initial tensile modulus in units of psi measured in the direction having the lower of the secant moduli at 125% elongation.

The measurement of the tensile elongation stress/strain properties of a distinct film in the longitudinal and transverse directions are measured according to ASTM D882 except as may be noted to the contrary herein. Obtain one-inch wide by two-inch long representative samples of the distinct film taken in the desired direction (i.e., longitudinal and transverse directions). Stretch the samples on a constant rate-of-cross-head-movement type of tension tester machine (e.g., an Instron brand tension tester) at a speed of 20 inches per minute past the breaking point of the sample to collect the stress-strain data. The initial tensile modulus is taken as the maximum tangent modulus (slope of the stress/strain curve) measured within the first 20% of elongation. The secant modulus at 125% elongation is taken as the stress/strain ratio at 125% elongation, excluding any samples which have broken before 125% elongation, or have begun to break before 125% elongation as evidenced by a distinct drop in the stress reading at or before this elongation.

Each distinct film of the plurality of distinct films may have an initial tensile modulus (in either or both of the longitudinal and transverse directions) of at least, and/or at most, any of the following: 10,000; 15,000; 20,000; 25,000; 30,000; 40,000; 70,000; 80,000; 90,000; 100,000; 150,000; 200,000; 250,000; 300,000; 350,000; and 400,000 pounds/square inch (psi), measured at a temperature of 73° F.

Each distinct film of the plurality of distinct films may have a secant modulus at 125% elongation (in either or both of the longitudinal and transverse directions) of at least, and/or at most, any of the following: 1,000; 3,000; 4,000; 5,000; 6,000; 7,000; 8,000; 9,000; 10,000; 12,000; 15,000; 20,000; 25,000; 30,000; and 40,000 pounds/square inch (psi), measured at a temperature of 73° F.

The distinct film may have a combination of any of these foregoing values of secant modulus and initial tensile modulus. For example, the distinct film may have a secant modulus at 125% elongation (taken as the lower value of the longitudinal and transverse directions) of at least 6,000 psi and an initial tensile modulus (in the same direction as the secant modulus measurement) of at most 400,000 psi. Also by way of example, the distinct film may have a secant modulus at 125% elongation (taken as the lower value of the longitudinal and transverse directions) of at least 7,000 psi and an initial tensile modulus (in the same direction as the secant modulus measurement) of at most 100,000 psi.

Although not wishing to be bound by this theory, Applicants believe that the distinct films of the plurality of distinct films may enhance the ballistic-resistance performance of the composite assembly when the distinct films start to stretch relatively easily at the initial impact of the projectile bullet to adopt the shape of the impact without fracturing. This attribute is believed to be reflected by the distinct film having a relatively low initial tensile modulus. However, as the impact progresses and the distinct films absorb impact energy and transfer the stress outwardly, it is believed advantageous that the distinct films also strain harden so that the distinct films' resistance to stretch enhances as the stretch caused by the impact progresses. This attribute is believe to be reflected by a relatively high secant modulus at 125% elongation.

Each distinct film of the plurality of distinct films that comprise polyolefin may have a birefringence of at least any of $5\times10^{-3}$, $6\times10^{-3}$, $7\times10^{-3}$, $8\times10^{-3}$, $9\times10^{-3}$, $10\times10^{-3}$, and $11\times10^{-3}$. Birefringence is determined as the average of the refractive index measurements taken at twelve in-plane (X-Y film plane) rotational positions made at 15° intervals, minus the refractive index measurement taken normal to the film plane (Z direction), the measurements made using a refractometer instrument (e.g., Metricon Model 2010/M prism coupler). It is believed that a higher birefringence value for a distinct film comprising polyolefin indicates a higher degree to which the polyolefin of the distinct film has attained molecular orientation, for example as provided by an orientation process as described herein. For a multilayer distinct film, the highest birefringence of any individual layer of the distinct film is taken as the birefringence of the distinct film.

Each distinct film of the plurality of distinct films that comprise polyolefin may have a crystallinity of at least 20% and/or at most 50%. Crystallinity may be determined by differential scanning calorimetry to determine the enthalpy of crystallization by the second heat, at 10° C. per minute, of the sample and comparing it to (i.e., divided by) the melt enthalpy of a 100% theoretical crystalline reference, as is known in the art. For a multilayer distinct film the crystallinity is taken as the average across all of the individual layers of the film.

Although not wishing to be bound by this theory, Applicants believe that a polyolefin film having the combination of a birefringence of at least $5\times10^{-3}$ and a crystallinity of from 20% to 50% provides a desirable combination of molecular orientation and crystallinity for the distinct film to have the desirable initial tensile modulus and secant modulus at 125% elongation performance as described herein.

IV. Manufacture of the Distinct Film

The distinct film may be manufactured by thermoplastic film-forming processes known in the art. The distinct film may be prepared by extrusion or coextrusion utilizing, for example, a tubular trapped bubble film process or a flat film (i.e., cast film or slit die) process. The distinct film may also be prepared by applying one or more layers by extrusion coating, adhesive lamination, extrusion lamination, solvent-borne coating, or by latex coating (e.g., spread out and dried on a substrate). A combination of these processes may also be employed. These processes are known to those of skill in the art.

The distinct film may be "non-oriented"—that is, the distinct film may not be subjected to an orientation step before its use in the composite assembly.

The distinct film may be oriented. The distinct film may be oriented in either the machine (i.e., longitudinal), the transverse direction, or in both directions (i.e., biaxially oriented), for example, to enhance the strength, optics, and durability of the film. A web or tube of the film may be uniaxially or biaxially oriented by imposing a draw force at a temperature where the film is softened (e.g., above the vicat softening point; see ASTM 1525) but at a temperature below the film's melting point. The distinct film may then be quickly cooled to retain the physical properties generated during orientation and to provide a molecularly oriented characteristic to the film. The distinct film may be oriented using, for example, a tenter-frame process or a bubble process. These processes are known to those of skill in the art, and therefore are not discussed in detail here. The orientation may occur in at least one direction by at least, and/or at most, any of the following ratios: 1.5:1, 2:1, 2.5:1, 3:1, 3.5:1, 4:1, 5:1, 6:1, 7:1, 8:1, 9:1, 10:1, 12:1, and 15:1.

The distinct film may be annealed or heat-set to reduce any heat shrink characteristic slightly or substantially; or the distinct film may not be heat set or annealed once the oriented distinct film has been quenched.

The distinct film may be a multilayer film produced by one or more lamination processes to combine two or more component films together. The component films may themselves have been oriented prior to lamination. Monoaxially oriented component films may thus be laminated so that the orientation directions are at a 90 degree angle with respect to one another. For example, the distinct film may be made using a process that is similar to that used to make Valeron® films from Illinois Tool Works. This cross-lamination process may serve to increase the ESI of the laminated distinct film relative to that of either component film by increasing the minimum secant modulus at 125% elongation of the laminated distinct film in longitudinal and transverse directions.

One or more of the layers of the distinct film—or at least a portion of the entire distinct film—may be cross-linked, for example, to improve the strength of the distinct film. Cross-linking may be achieved by using chemical additives or by subjecting one or more layers of the distinct film to one or more energetic radiation treatments—such as ultraviolet, X-ray, gamma ray, beta ray, and high energy electron beam treatment—to induce cross-linking between molecules of the irradiated material. Useful radiation dosages include at least any of the following: 5, 7, 10, 15, 20, 25, 30, 35, 40, 45, and 50 kGy (kiloGray). Useful radiation dosages include less than any of the following: 150, 130, 120, 110, 100, 90, 80, and 70 kGy. The cross-linking may occur before the orientation process, for example, to enhance the discrete film strength before orientation, or the cross-linking may occur after the orientation process.

It may be desirable to avoid irradiating a particular layer of the discrete film, for example a layer comprising PVdC or a radiation sensitive additive. To that end, substrate layers of the discrete film may be extruded and irradiated, and subsequent may then be applied to the irradiated substrate, for example, by an extrusion coating process.

V. Composite Assembly

Figure 2:
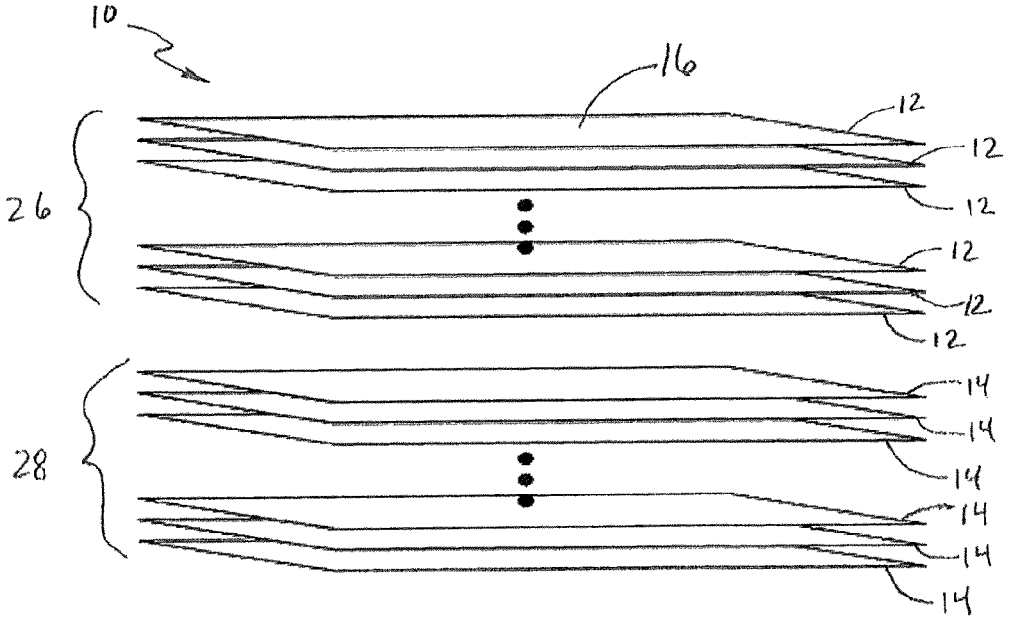
FIG. 2 is a representative exploded perspective view of the composite assembly 10 of FIG. 1.
Figure 3:
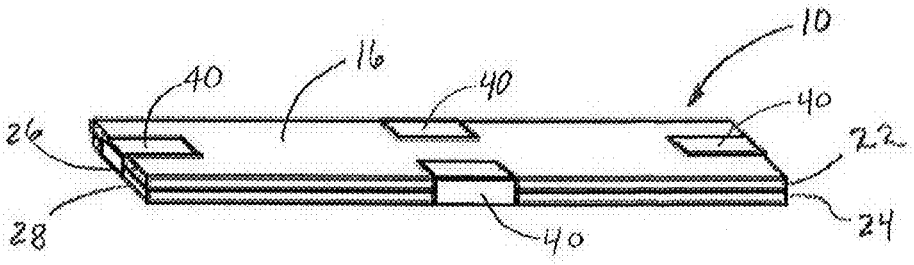
FIG. 3 is a representative perspective view of the composite assembly 10 of FIG. 2, with tape 40.

In an embodiment of the disclosed subject matter, composite assembly 10 comprises a plurality 22 of ballistic fabric layers 12 and a plurality 24 of distinct films 14 adjacent the plurality of ballistic fabric layers. (FIGS. 1-3.)

The plurality of ballistic fabric layers and the plurality of distinct films may be configured in a stacked arrangement adjacent each other to create the composite assembly 10 having a strike side 16, that is, the side of the composite assembly 10 that provides the higher level of ballistic resistance performance by the composite assembly when impacted by an incoming projectile relative to the ballistic resistance performance by the composite assembly when impacted by an incoming projectile on the opposite protected side 18 of the composite assembly 10. The strike side surface of the composite assembly may comprise a ballistic fabric layer. (FIG. 1.) The protected side surface of the composite assembly may comprise a distinct film. (FIG. 1.)

The ballistic fabric layers 22 may be arranged as a single base section 26 having each ballistic fabric layer directly adjacent two other ballistic fabric layers of the base section, except for the two outer ballistic fabric layers, each of which is directly adjacent only one other ballistic fabric layer. (FIGS. 1-2.) The distinct films 14 may be arranged in a single backing section 28 having each distinct film directly adjacent two other distinct films of the backing section, except for the two outer distinct films, each of which is directly adjacent only one other distinct film. (FIGS. 1-2.) The base section 26 of ballistic fabric layers may be directly adjacent the backing section 28 of distinct films. (FIGS. 1-3.)

Figure 4:
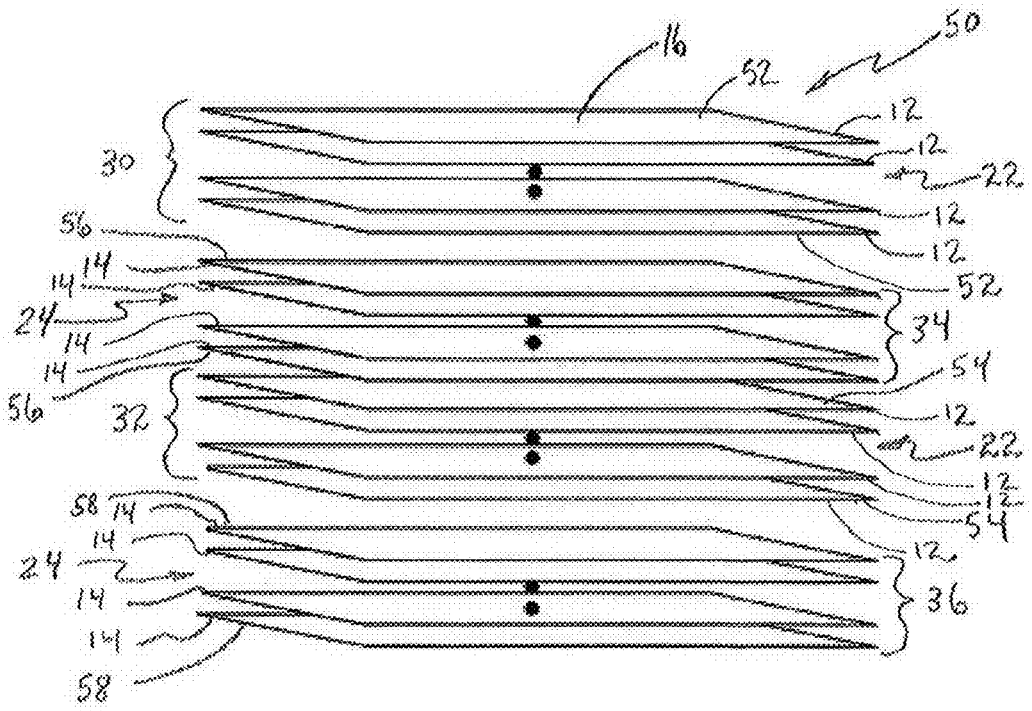
FIG. 4 is a representative exploded perspective view of a composite assembly 50 of another embodiment of the presently disclosed subject matter.
Figure 5:
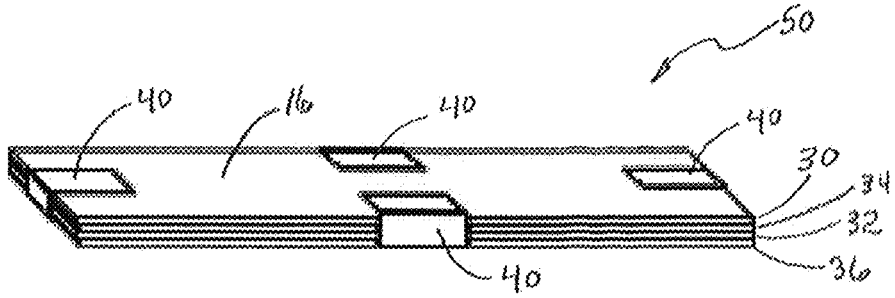
FIG. 5 is a representative perspective view of the composite assembly of FIG. 4, with tape 40.

The ballistic fabric layers 12 of the plurality of ballistic fabric layers 22 may be arranged in two or more sections; for example, composite assembly 50 comprises a first section 30 of ballistic fabric layers 12 and second section 32 of ballistic fabric layers 12. (FIGS. 4-5.) The first section 30 has each ballistic fabric layer 12 directly adjacent two other ballistic fabric layers of the first section 30, except for the two outer ballistic fabric layers 52 of the first section, each of which is directly adjacent only one other ballistic fabric layer of the first section; and the second section 32 has each ballistic fabric layer 12 directly adjacent two other ballistic fabric layers of the second section 32, except for the two outer ballistic fabric layers 54 of the second section, each of which is directly adjacent only one other ballistic fabric layer of the second section. The first and section sections 30, 32 of the plurality of ballistic fabrics may be adjacent each other with an intervening grouping of some distinct films 14, as illustrated in FIGS. 4-5, or the first and second sections of ballistic fabric layers may be directly adjacent each other (not illustrated).

The distinct films 14 of the plurality of distinct films 24 may be arranged in two or more sections; for example, composite 50 comprises first section 34 of distinct films 14 and second section 36 of distinct films 14. (FIGS. 4-5.) The first section 34 has each distinct film 14 directly adjacent two other distinct films of the first section 34, except for the two outer distinct films 56 of the first section 34, each of which is directly adjacent only one other distinct film of the first section; and the second section 36 has each distinct film 14 directly adjacent two other distinct films, except for the two outer distinct films 58 of the second section 36, each of which is directly adjacent only one other distinct film of the second section. The first and section sections 34, 36 of the plurality of distinct films 24 may be adjacent each other with an intervening grouping of some ballistic fabric layers 12, as illustrated in FIGS. 4-5, or the first and second sections of distinct films may be directly adjacent each other (not illustrated).

Figure 6:
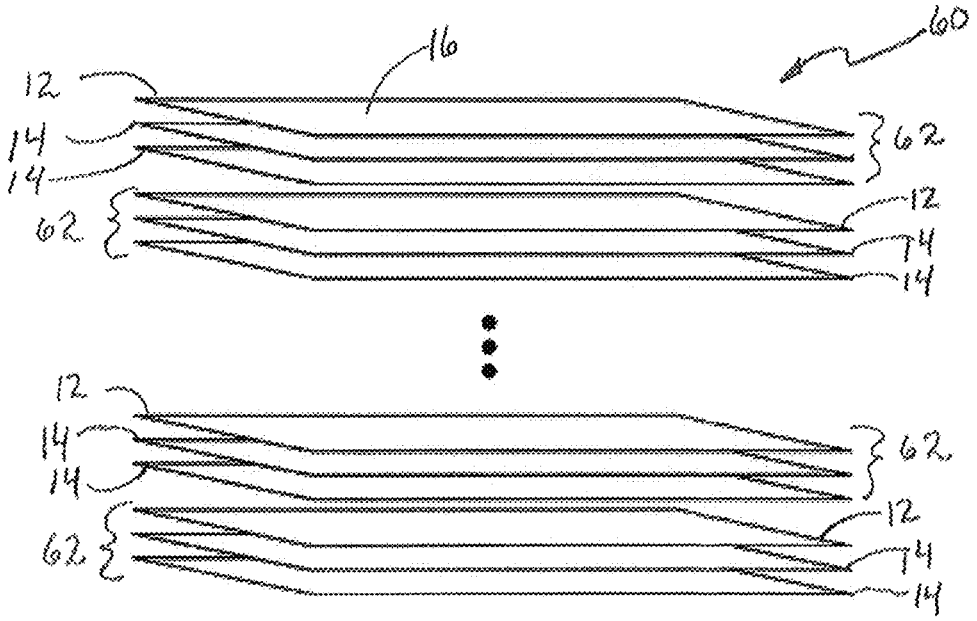
FIG. 6 is a representative exploded perspective view of a composite assembly 60 of another embodiment of the presently disclosed subject matter.
Figure 7:
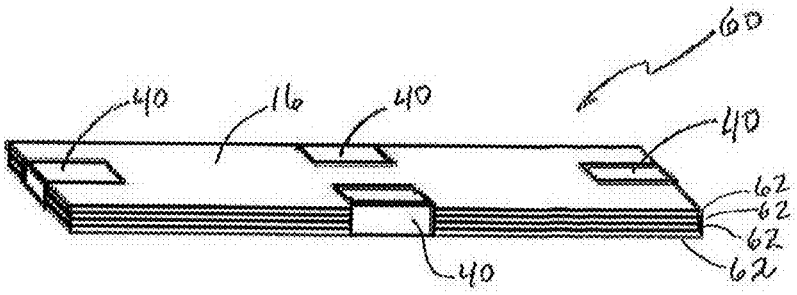
FIG. 7 is a representative perspective view of the composite assembly of FIG. 6, with tape 40.

The ballistic fabric layers 12 of the plurality of ballistic fabric layers may be adjacent the distinct films 14 of the plurality of distinct films in a sequenced arrangement of alternating or repeating groups of ballistic fabric layer(s) and distinct film(s). For example, composite assembly 60 comprises a plurality of repeating groups 62 each comprising a ballistic fabric layer 12 and two distinct films 14. (FIGS. 6-7.)

The ballistic fabric layers 12 of the composite assembly may be configured in stacked arrangement. (FIGS. 1-7.) The composite assembly may be configured such that at least any of the following percentages of the total number of ballistic fabric layers are directly adjacent at least two other ballistic fabric layers of the plurality of ballistic fabric layers: 60%, 65%, 70%, 75%, 80%, 85%, 90%, and 95%. The distinct films 14 of the composite assembly may be configured in stacked arrangement. (FIGS. 1-7.) The composite assembly may be configured such that at least any of the following percentages of the total number of distinct films are directly adjacent at least two other distinct films of the plurality of distinct films: 60%, 65%, 70%, 75%, 80%, 85%, 90%, and 95%.

In the composite assemblies disclosed herein having a plurality of ballistic fabrics 12 adjacent the plurality of distinct films 14, the weight of ballistic fabric may be oriented more toward the projectile strike side 16 of the composite assembly and the weight of the distinct films may be oriented more toward the protected side 18 of the composite assembly. This can be characterized by locating at least any of 60%, 70%, 80%, 90%, 95%, and 100% of the total weight of the plurality of distinct films within a region extending for a distance corresponding to 50% of the total weight of the composite assembly from the protected side of the composite assembly, where the composite assembly has a total weight defined as the sum of the weights of the plurality of ballistic fabric layers and the plurality of distinct films.

The composite assembly may comprise a number of ballistic fabric layers of at least, and/or at most, any of 5, 6, 7, 8, 9, 10, 12, 15, 20, 25, 30, and 40 ballistic fabric layers. The composite assembly may comprise a number of distinct films of at least, and/or at most, any of 5, 6, 7, 8, 9, 10, 12, 15, 20, 25, 30, 35, 40, 45, 50, 60, 70, 80, 90, and 100 distinct films.

The composite assembly may comprise a total areal density of ballistic fabric layers of at least, and/or at most, any of the following amounts: 0.4, 0.5, 0.7, 0.9, 1.0, 1.2, 1.4, 1.6, 1.8, and 2.0 pounds per square foot. The composite assembly may comprise a total areal density of distinct films of at least, and/or at most, any of the following amounts: 0.1, 0.2, 0.3, 0.4, 0.5, 0.7, 0.9, 1.0, 1.2, 1.4, 1.6, 1.8, and 2.0 pounds per square foot. The composite assembly may have a total areal density based on the sum of the areal densities of the plurality of ballistic fabrics and the plurality of distinct films of at least, and/or at most, any of the following amounts: 0.8, 0.9, 1.0, 1.1 1.2, 1.4, 1.6, 1.8, 2.0, 2.2, 2.4, and 2.5 pounds per square foot.

The composite assembly may have at least, and/or at most, any of the following weight parts of distinct films relative 100 weight parts of the combination of the weight of the distinct films and the ballistic fabric layers: 60, 55, 50, 45, 40, 35, 30, 25, 20, 15, and 10 weight parts.

The ballistic fabric layers may be stacked in an unsecured relationship. Alternatively, portions of ballistic fabric layers of the plurality of the ballistic fabric layers may be attached to one another, for example, by less than any of 80%, 50%, 30%, 20%, and 10% of the coextensive surface area. The distinct films may be stacked in an unsecured relationship. Alternatively, portions of the distinct films of the plurality of distinct films may be attached to one another, or to the ballistic fabric layers, for example, by less than any of 80%, 50%, 30%, 20%, and 10% of the coextensive surface area.

The ballistic fabric layers may be secured in selected regions by any of stitching, adhesive bonding, melt bonding, or taping, for example, continuous stitching 70 in the perimeter or edge regions of composite assembly 70 (FIG. 8), stitching in a cross or "X" pattern configuration (not illustrated), in a discontinuous pattern of stitching 82 of composite assembly 80 (FIG. 9), in a quilted pattern (not illustrated), or taped, for example, in selected regions by tape 40 (FIGS. 3, 5, 7).

VI. Body Armor

A body armor article may comprise any of the composite assemblies described herein. Such armor includes, for example, body armor such as vests (e.g., as may be worn by law enforcement officers or military personnel) and jackets. The body armor may comprise the composite assembly as the internal ballistic panel retained within an armor carrier that supports and secures the body armor garment to the user.

VII. Examples

The following examples are presented for the purpose of further illustrating and explaining the present invention and are not to be taken as limiting in any regard. Unless otherwise indicated, all parts and percentages are by weight.

The following materials were used in preparing composite assemblies for ballistic testing.

A. Fabrics

"Aramid-1" is a plain-weave woven ballistic fabric of aramid (poly-paraphenylene terephthalamide) yarn (DuPont Kevlar® 29 yarn having 3000 denier) having an areal density of 30.38 g/sq.ft available from BGF Industries under the product code 05712.

"Aramid-2" is a plain-weave woven ballistic fabric of aramid (poly-paraphenylene terephthalamide) yarn (Hyosung Alkex® fabric having a 1500 denier) having an areal density of 51.31 g/sq.ft. available from Absecon Mills under the product code 14923.

"Aramid-3" was not used.

"Aramid-4" is a pseudo-unidirectional weave woven ballistic fabric of aramid (DuPont Kevlar® yarn having 1000 denier) having an areal density of 48.43 g/sq.ft available from DuPont under the Kevlar® XP S102 trade name.

"Olefin-1" is a consolidated ballistic fabric comprising four consolidated plies of unidirectional Spectra® fiber, cross-plied at 0°/90°/0°/90° and sandwiched within thermoplastic film, having an areal density of 16.4 g/sq.ft (177 g/m2), and available from Honeywell Corporation under the Honeywell Spectra II® SA-3118 trade name; where the Spectra® fiber comprises gel-spun oriented-strand fibers of ultra-high molecular weight polyethylene.

"Olefin-2" is a consolidated ballistic fabric comprising four consolidated plies of unidirectional Spectra® fiber, cross-plied at 0°/90°/0°/90°, having an areal density of 23.9 g/sq.ft (257 g/m2), and available from Honeywell Corporation under the Honeywell Spectra II® SA-3137 trade name; where the Spectra® fiber comprises gel-spun oriented-strand fibers of ultra-high molecular weight polyethylene.

B. Resins

"LLDPE-1" is a linear low density polyethylene having a density of 0.912 glee and a melt flow index of 1.0 g/10 min.

"LLDPE-2" is a linear low-density polyethylene having a density of 0.916 g/cc and a melt flow index of 1.3 g/10 min.

"EVA 1" is an ethylene/vinyl acetate copolymer having a vinyl acetate comonomer content of 27 wt. % and a melt index of 5.75 g/10 min.

C. Distinct Films

"Coex-1" is a 5-layer symmetrical film having a thickness of 4.5 mils, an areal density of 9.77 g/sq.ft. and a composition and layer configuration of A/B/C/B/A where:

A=a layer of about 12.5% of the total film thickness comprising LLDPE-1;

B=a layer of about 30% of the total film thickness comprising LLDPE-2; and

C=a layer of about 15% of the total film thickness comprising EVA-1.

The Coex-1 film was produced by coextruding a water-quenched tubular 32 mil thick, 3-layer tape, then crosslinking the tape under an electron beam, and then re-heating and orienting the crosslinked tape in a bubble process at an expansion ratio (machine direction MD×transverse direction TD) of about 3.5×4.0 to produce a three-layer, 2.25 mil thick structure having an EVA-1 layer directed to the inside surface of the bubble. The orientation bubble was then collapsed to lay flat so that the inside EVA-1 layers of the orientation bubble bonded to each other to form the C layer, resulting in a self-welded symmetrical 5-layer material of 4.5 mil thickness. The Coex-1 film had an initial tensile modulus of 35,646 psi, a secant modulus at 125% of 9,174 psi, an elongational strength index of 1,495 psi, a birefringence of $12.1\times10^{-3}$, and a crystallinity of 36%.

"Coex-1a" is a film structure similar to Coex-1 in all respects except that the total thickness is 5.6 mils and the areal density of 12.09 g/sq.ft.

"Coex-1b" is a film structure similar to Coex-1 in all respects except that the Coex-1b film was conditioned (annealed) at 145° F. for one day prior to testing, whereas the Coex-1 film was not conditioned (annealed) at an elevated temperature.

"Coex-1c" is a film structure similar to Coex-1 in all respects except that the temperature of the collapsing nip roll after bubble orientation was about 160° F. (up from 110° F. for the Coex-1 film).

"Coex-1d" is a film structure similar to Coex-1 in all respects except that the electron beam dose level was about 40% lower than that used for the Coex-1 film.

"Coex-1e" is a film structure identical to Coex-1 in all respects except that the electron beam dose level was about 20% higher.

"Coex-2" is a 2-layer film having a total thickness of 2.1 mils, an areal density of 4.53 g/sq.ft, and a composition and layer configuration of A/B where:

A=a layer of about 25% of the total film thickness comprising LLDPE-1; and

B a layer of about 75% of the total film thickness comprising LLDPE-2.

The Coex-2 film was produced by coextruding a water-quenched tubular 30 mil thick, 2-layer tape, then crosslinking the tape under an electron beam, and then re-heating and orienting the crosslinked tape in a bubble process at an expansion ratio (MD×TD) of about 3.5×4.0 to produce the 2.1 mil thick film. In contrast with Coex-1, the Coex-2 film was not self-welded into a symmetrical structure after orientation because of the lack of EVA resin in the formulation. The Coex-2 film had an initial tensile modulus of 50,251 psi, a secant modulus at 125% of 11,571 psi, an elongational strength index of 1,222 psi, a birefringence of $11.6\times10^{-3}$, and a crystallinity of 44%.

"Coex-3" is a 5-layer symmetrical film having a thickness of 4.1 mils, an areal density of 8.9 g/sq.ft, and a composition and layer configuration of A/B/C/B/A where:

A=a layer of about 12.5% of the total film thickness comprising LLDPE-1;

B=a layer of about 30% bulk of the total film thickness comprising LLDPE-2; and

C=a layer of about 15% of the total film thickness core comprising EVA-1.

The Coex-3 film was produced by coextruding a 2.1 mil thick, 3-layer blown film having an EVA-1 layer directed to the inside surface of the bubble. The bubble was collapsed to lay flat so that the inside EVA-1 layers bonded to each other to form the C layer, resulting in a self-welded symmetrical 5-layer material of 4.1 mil thickness. In contrast with the Coex-1 film, this film was neither crosslinked nor oriented. The Coex-3 film had an initial tensile modulus of 22,626 psi, a secant modulus at 125% of 1,031 psi, an elongational strength index of 46 psi, a birefringence of $1.2\times10^{-3}$, and a crystallinity of 40%.

"Coex-4" is a multilayer blown, unoriented film having 2.5 mil thickness and an areal density of 5.6 g/sq.ft, comprising about 60 wt. % linear low density polyethylene and about 40 wt. % polypropylene available from Sealed Air Corporation under the TuffGard® mil trade name. The Coex-4 film had an initial tensile modulus of 61,502 psi, a secant modulus at 125% of 1,620 psi, an elongational strength index of 37 psi, a birefringence of $2.1\times10^{-3}$, and a crystallinity of 42%.

"Mono-1" is a 3.2 mil thick cast, unoriented film comprising a copolymer of polyurethane and polyester and having an areal density of 7.17 g/sq.ft available from Sealed Air Corporation under the Korrvu trade name. The Mono-1 film had an initial tensile modulus of 6,946 psi, a secant modulus at 125% of 1,013 psi, and elongational strength index of 144 psi.

"Mono-2" is a 2.95 mil thick, cross-laminated (i.e., two uniaxially oriented films are laminated together with their orientation directions crossed at roughly 90°) comprising high density polyethylene and having an areal density of 6.13 g/sq.ft available from Illinois Tool Works Inc. under the Valeron® trade name. The Mono-2 film had an initial tensile modulus of 107,714 psi, a secant modulus at 125% of 5,768 psi, an elongational strength index of 252 psi, a birefringence of $4.6\times10^{-3}$, and a crystallinity of 79%.

"Mono-3" is a 2.0 mil thick, biaxially-oriented, heat set film comprising polyethylene terephthalate (PET) and having an areal density of 6.62 g/sq.ft, available from DuPont-Teijin Films under the Mylar®-A trade name. The Mono-3 film had an initial tensile modulus of 576,915 psi, a secant modulus at 125% of 23,858 psi, and an elongational strength index of 724 psi.

"Mono-4" is a 5.2 mil thick, unoriented cast film comprising DuPont Surlyn® ionomer and having an areal density of 11.66 g/sq.ft available from Flex-O-Glass Inc. under the Sur-Flex trade name. The Mono-4 film had an initial tensile modulus of 46,060 psi, a secant modulus at 125% of 1,957 psi, an elongational strength index of 65 psi, a birefringence of $2.7\times10^{-3}$, and a crystallinity of 25%

"Mono-5" is a 2.8 mil thick, 3-layer blown, unoriented film having an areal density of 6.54 g/sq.ft comprising the following polyamides (approximate weight percentages): nylon-6 (50 wt. %), nylon-6,6/6,10 (20 wt. %), nylon 6,6 (20 wt. %), and nylon 6/6,6 (10 wt. %). The Mono-5 film had an initial tensile modulus of 215,785 psi, a secant modulus at 125% of 4,504 psi, and an elongational strength index of 85 psi.

"Mono-6" is a 4.0 mil thick, unoriented, cast film having an areal density of 11.14 g/sq.ft comprising and Eastman Tritan® polyester available from Eastman Chemical Company under the Tritan® film trade name. The Mono-6 film had an initial tensile modulus of 195,326 psi, a secant modulus at 125% of 5,310 psi, and an elongational strength index of 145 psi.

D. Composite Assemblies

Samples of square-shaped (e.g., 16 inches by 16 inches) composite assemblies were prepared, each comprising the indicated number of layers of the specified ballistic fabric and/or the distinct films, as indicated in the tables below.

The composite assemblies were configured in any one of the four construction types described below as Type A to Type D, depending on the type of stitching and assembly. Each of the composite assemblies was also held together loosely by straps of duct tape wrapped around one or more edges and adhered to the front and back faces of the composite assembly, at least 3 inches away from the bullet contact location (see tape 40 of FIGS. 3, 5, 7).

Figure 8:
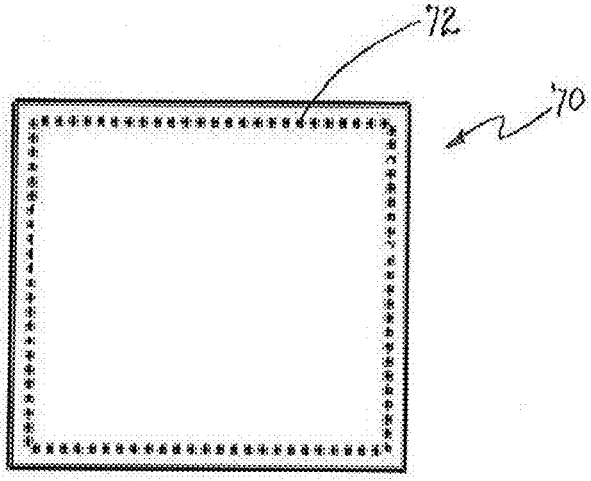
FIG. 8 is a representative top view of a composite assembly 70 of another embodiment of the presently disclosed subject matter showing a stitching pattern.

For the "Type A" composite assembly, the ballistic fabric layers were perimeter stitched together in one or two groupings, approximately ½ inch from the edges, as illustrated in FIG. 8. The distinct films were unstitched. The several layers of ballistic fabric were configured in a base section. The several distinct films were configured in a backing section. The base section was directly adjacent the backing section so that the base section was positioned on the projectile strike side and the backing section was positioned on the protected side, adjacent the clay backing material of the test. Accordingly, the Type A composite assembly had the stack configuration similar to FIGS. 1-3.

Figure 9:
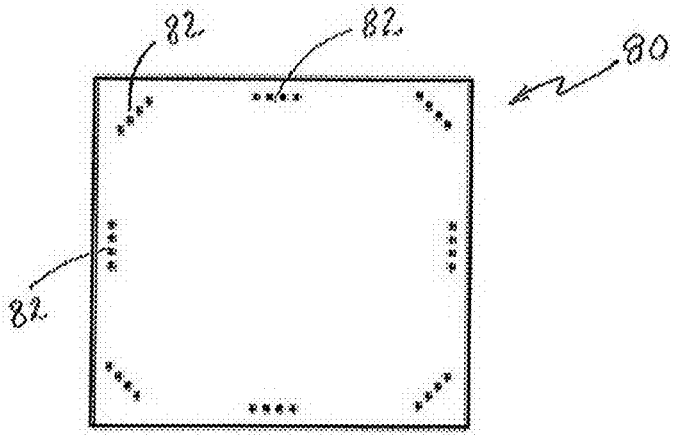
FIG. 9 is a representative top view of a composite assembly 80 of still another embodiment of the presently disclosed subject matter showing another stitching pattern.

For the "Type B" composite assembly, the ballistic fabric layers of the base section were stitched together in one or two groupings. The stitching pattern comprised a series of eight 1-inch length segments, one stitch segment near each of the four corners and one stitch segment near the edge midway between the corners, for a total of eight stitch segments, as illustrated in FIG. 9. All stitch segments were about 1 inch from the edge and oriented perpendicular to the radial direction. The several distinct films of the backing section were unstitched. The base section of the several layers of ballistic fabric was located directly adjacent the backing section of the several distinct films so that the base section was on the projectile strike side and the backing section was on the protected side, adjacent the backing material (i.e., clay) of the test. Accordingly, the Type B composite assembly had the stack configuration similar to FIGS. 1-3.

For the "Type C" composite assembly, the ballistic fabric layers of a first section and the ballistic fabrics of a second section were each stitched in the eight positions as described for Type B composite assembly above. A first section of distinct films and a second section of distinct films were also arranged. The distinct films were unstitched. The composite assembly was arranged as follows: the first section of ballistic fabrics was on the projectile strike side, then first section of distinct films, then the second section of ballistic fabrics, followed by the second section of distinct films on the protected side, adjacent the backing material (i.e., clay) of the test. Accordingly, the Type C composite assembly had the stack configuration similar to FIGS. 4-5.

For the "Type D" composite assembly, the both the ballistic fabric layers and the distinct films were unstitched. The ballistic fabric layers and the distinct films were sequenced in alternating repeating groups of one ballistic fabric layer toward the projectile strike side and two distinct films toward the protected side. Accordingly, the Type D composite assembly had the stack configuration similar to FIGS. 6-7.

E. Ballistic Testing of Composite Assemblies

The composite assemblies were tested for backface signature ("BFS") and/or ballistic limit ("V50") according to NIJ Standard 0101.06 for Ballistic Resistance of Body Armor, unless as otherwise noted herein. This NIJ Standard 0101.06 is incorporated herein in its entirety by reference.

1. Target Set E

For the target set E, the measurement of BFS was made using a 12×12×5 inch clay backing material target. The composite assembly was attached to the front of the target by means of 1 inch wide furring strips attached through the composite assembly to the frame at all four sides with wood screws. The weapon used was a Glock 33 .357 SIG pistol. The bullets used were Doubletap full metal jacket, 125 grain. Shots were fired from a distance of about 15 feet. The average muzzle velocity was determined to be 1325.8 ft/sec with a standard deviation of 31.2 ft/sec. The targets were shot 5 times with a spacing of about 4 inches between bullet strike points, and at least 2 inches from the edge of the target. The configuration and composition of the composite samples, and BFS test results are shown below in Tables 1a and 1b.

TABLE 1a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq.ft) |
|---|---|---|---|---|---|---|---|
| E-1 (Control) | A (17") | Aramid-1 | 24 | none | 0 | 100/0 | 1.61 |
| E-2 | A (17") | Aramid-1 | 11 | Coex-1 | 19 | 65/35 | 1.13 |
| E-3 | A (17") | Aramid-1 | 11 | Coex-1 | 29 | 55/45 | 1.34 |
| E-4 | A (17") | Aramid-1 | 11 | Coex-1 | 38 | 48/52 | 1.53 |
| E-5 | A (17") | Aramid-1 | 9 | Coex-1 | 45 | 39/61 | 1.54 |
| E-6 | A (17") | none | 0 | Coex-1 | 77 | 0/100 | 1.61 |

TABLE 1b

| Composite Assembly Sample | Wt. % Fabric Layers/ Wt. % Films | Areal Density (lbs/sq. ft) | BFS average (mm) | Standard Deviation (mm) | Performance relative to Control |
|---|---|---|---|---|---|
| E-1 (Control) | 100/0 | 1.61 | 19.5 | 1.3 (n = 4)* | |

TABLE 1b-continued

| Composite Assembly Sample | Wt. % Fabric Layers/ Wt. % Films | Areal Density (lbs/sq. ft) | BFS average (mm) | Standard Deviation (mm) | Performance relative to Control |
|---|---|---|---|---|---|
| E-2 | 65/35 | 1.13 | 16.3 | 4.3 (n = 4)* | 16% BFS decrease |
| E-3 | 55/45 | 1.34 | 14.3 | 1.7 (n = 4)* | 27% BFS decrease |
| E-4 | 48/52 | 1.53 | 13.7 | 2.1 (n = 3)** | 30% BFS decrease |
| E-5 | 39/61 | 1.54 | perf. | | |
| E-6 | 0/100 | 1.61 | perf. | | |

"perf." means that the bullets caused perforating impacts.

*one shot was too close to the edge and was not included.

**two shots were too close to the edge and were not included.

It was surprising and unexpected that the BFS average improved (decreased) by the amount shown for samples E-2 through E-4 (relative the E-1 control) by incorporating aback-ing section of films oriented toward the protected side, even with the accompanying mass reduction in the amount of ballistic fabric.

2. Target Set F

The target set F were tested in the same manner as target set E, except that the shots were fired from a distance of about 16 feet. The average muzzle velocity was determined to be 1326 ft/sec with a standard deviation of 31 ft/sec. The configuration and composition of the composite samples, and BFS test results are shown below in Tables 2a and 2b.

TABLE 2a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| F-1 (Control) | A (17") | Aramid-1 | 24 | none | 0 | 100/0 | 1.61 |
| F-2 | A (17") | Aramid-1 | 11 | Coex-1 | 19 | 65/35 | 1.13 |
| F-3 | A (17") | Aramid-1 | 11 | Coex-1b | 19 | 65/35 | 1.13 |

TABLE 2b

| Composite Assembly Sample | Wt. % Fabric Layers/ Wt. % Films | Areal Density (lbs/sq. ft) | BFS average (mm) | Standard Deviation (mm) | Performance relative to Control |
|---|---|---|---|---|---|
| F-1 Control | 100/0 | 1.61 | 19.2 | 2.5 (n = 5) | |
| F-2 | 65/35 | 1.13 | 16.0 | 2.7 (n = 4)* | 17% BFS decrease |
| F-3 | 65/35 | 1.13 | 17.0 | 2.3 (n = 5) | 11% BFS decrease |

*one shot was rejected as it was too near the edge and fully penetrated the fabric.

The difference between the F-2 and the F-3 composite assemblies was the nature of the backing section film of the assembly composite. The F-2 backing films were not annealed; and the F-3 backing films were annealed. Anneal-ing may be used to limit the potential shrinkage of an oriented backing film under heat exposure associated with some ballistic applications. The similar BFS performance of F-2 and F-3 indicate that the annealing did not significantly affect the BFS performance.

3. Target Set G

The target set G was tested in the same manner as target set E, except that the shots were fired from a distance of about 16 feet. The configuration and composition of the composite samples, and BFS test results are shown below in Tables 3a and 3b.

TABLE 3a

| Composite Assembly Sample | Composite Assembly Type/ Length of square side (inches) | Ballistic Fabric Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| G-1 (Control) | A (17") | Aramid-1 | 24 | none | 0 | 100/0 | 1.61 |
| G-2 | A (17") | Aramid-1 | 11 | Coex-1 | 19 | 65/35 | 1.14 |
| G-3 | A (17") | Aramid-1 | 12 | Coex-1 | 38 | 50/50 | 1.62 |
| G-4 | A (17") | Aramid-1 | 18 | Coex-1 | 19 | 75/25 | 1.61 |
| G-5 | A (17") | Aramid-1 | 18 | Coex-1b | 19 | 75/25 | 1.63 |

TABLE 3b

| Composite Assembly Sample | Wt. % Fabric Layers/ Wt. % Films | Areal Density (lbs/sq. ft) | BFS average (mm) | Standard Deviation (mm) | Performance relative to Control |
|---|---|---|---|---|---|
| G-1 (Control) | 100/0 | 1.61 | 19.2 | 0.4 (n = 5) | |
| G-2 | 65/35 | 1.14 | 14.0 | 1.6 (n = 5) | 27% BFS decrease |
| G-3 | 50/50 | 1.62 | 13.6 | 1.9 (n = 5) | 29% BFS decrease |
| G-4 | 75/25 | 1.61 | 15.0 | 1.2 (n = 5) | 22% BFS decrease |
| G-5 | 75/25 | 1.63 | 15.2 | 1.9 (n = 5) | 21% BFS decrease |

It was surprising and unexpected that the BFS average improved by the amount shown for samples G-2 through G-5 (relative the G-1 control) by incorporating the backing section of film layers, even with the accompanying mass reduction for the amount of penetration-resistant fabric.

It was unexpected and surprising that the BFS (14.0 mm) of the G-2 composite assembly was similar to the BFS (15.0 mm) of the G-4 composite assembly, where the only difference in construction was that the G-4 composite assembly had 7 fewer fabric layers of penetration-resistant Aramid-1.

The difference between the G-4 and the G-5 composite assemblies was the nature of the backing section film of the assembly composite. The G-4 backing films were not annealed; and the G-5 backing films were annealed. Annealing may be used to limit the potential shrinkage of an oriented backing film under heat exposure associated with some ballistic applications. The similar BFS performance of G-4 and G-5 indicate that the annealing did not significantly affect the BFS performance.

4. Target Set H

For the target set H, the measurement of BFS was made using a 12×12×5 inch clay target. The composite assembly was clamped to the face of a clay target using removable clamps at each of the four corners. Clamps were re-positioned between shots. The weapon used was a Remington .44 Magnum pistol, using a Ransom Master Series Rest holder. The ammunition used was Speer Gold Dot jacketed hollow point, 240 grain. Shots were fired from a distance of 16.5 feet. The average muzzle velocity was determined to be 1281 ft/sec with a standard deviation of 25 ft/sec. The targets were shot 5 times in a spaced pattern with a spacing of about 5 inches between bullet strike points, and at least 3 inches from the edge of the target. The configuration and composition of the composite samples, and BFS test results are shown below in Tables 4a and 4b.

TABLE 4a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| H-1 (Control) | A (17") | Aramid-1 | 24 | none | 0 | 100/0 | 1.61 |
| H-2 | A (17") | Aramid-1 | 18 | Coex-1 | 19 | 75/25 | 1.61 |
| H-3 | A (17") | Aramid-1 | 18 | Mono-1 | 26 | 75/25 | 1.62 |
| H-4 (Control) | A (17") | Olefin-2 | 18 | none | 0 | 100/0 | 0.95 |
| H-5 | A (17") | Olefin-2 | 13 | Coex-1 | 15 | 68/32 | 1.01 |

TABLE 4b

| Composite Assembly Sample | Wt. % Fabric Layers/Wt. % Films | Areal Density (lbs/sq. ft) | BFS average (mm) | Standard Deviation (mm) | Performance relative to Control | Elongational Strength Index of Films (psi) |
|---|---|---|---|---|---|---|
| H-1 (Control) | 100/0 | 1.61 | 40.8 | 1.3 (n = 5) | | |
| H-2 | 75/25 | 1.61 | 28.4 | 3.2 (n = 5) | 30% BFS decrease to H-1 | 1495 |
| H-3 | 75/25 | 1.62 | 44.6 | 7.2 (n = 5) | 9% BFS increase to H-1 | 144 |
| H-4 (Control) | 100/0 | 0.95 | 48.0 | 7.1 (n = 3)* | | |
| H-5 | 68/32 | 1.01 | 40.7 | 10.7 (n = 3)* | 15.2% BFS decrease to H-4 | 1495 |

*Two shots were excluded due to proximity to fabric edge.

It was surprising and unexpected that the BFS average improved by the 30% amount shown for sample H-2 (relative the H-1 control) by incorporating the backing section of Coex-1 films, even with the accompanying mass reduction for the amount of ballistic fabric layers.

It was surprising and unexpected that the BFS average improved (decreased) by 36% for sample H-2 relative H-3 by incorporating the backing section of Coex-1 films (having elongational strength index of 1495 psi) instead of the backing section of Mono-1 films (having elongational strength index of 144).

5. Target Set I

The target set I was tested in the same manner as target set H. The average muzzle velocity was determined to be 1277 ft/sec with a standard deviation of 23 ft/sec. The configuration and composition of the composite samples, and BFS test results are shown below in Tables 5a and 5b.

TABLE 5a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| I-1 (Control) | A (15") | Olefin-1 | 33 | none | 0 | 100/0 | 1.20 |
| I-2 | A (15") | Olefin-1 | 25 | Coex-1 | 13 | 76/24 | 1.19 |
| I-3 | A (15") | Olefin-1 | 25 | Coex-1c | 13 | 76/24 | 1.20 |

TABLE 5b

| Composite Assembly Sample | Wt. % Fabric Layers/ Wt. % Films | Areal Density (lbs/sq. ft) | BFS average (mm) | Standard Deviation (mm) | Performance relative to Control |
|---|---|---|---|---|---|
| I-1 (Control) | 100/0 | 1.20 | 29.7 | 0.6 (n = 3)* | |
| I-2 | 76/24 | 1.19 | 30.3 | 2.6 (n = 4) | 2% BFS increase to I-1 |

TABLE 5b-continued

| Composite Assembly Sample | Wt. % Fabric Layers/ Wt. % Films | Areal Density (lbs/sq. ft) | BFS average (mm) | Standard Deviation (mm) | Performance relative to Control |
|---|---|---|---|---|---|
| I-3 | 76/24 | 1.20 | 30.0 | 2.3 (n = 4) | 1% BFS increase to I-1 |

*One shot was excluded due to proximity to fabric edge.

It was surprising and unexpected that the BFS average was in essence the same for sample I-2 and I-3 (relative the I-1 control) by incorporating the backing section of distinct films, even with the accompanying mass reduction for the amount of Olefin-1 ballistic fabric layers.

The difference between the I-2 and the I-3 composite assemblies was the nature of the backing section films of the assembly composite. The I-2 films were not annealed; and the I-3 films were annealed. Annealing may be used to limit the potential shrinkage of an oriented film under heat exposure associated with some ballistic applications. The similar BFS performance of I-2 and I-3 indicate that the annealing did not significantly affect the BFS performance.

6. Target Set J

The target set J was tested in the same manner as target set H, except that the weapon used was a Ruger Super Blackhawk .44 Magnum pistol; and the average muzzle velocity was determined to be 1427 ft/sec with a standard deviation of 26 ft/sec. The configuration and composition of the composite samples, and BFS test results are shown below in Tables 6a and 6b.

TABLE 6a

| Composite Assembly Sample | Composite Assembly Type/ Length of square side (inches) | Fabric Layer Composition | Total Number of Fabric Layers | Films Composition | Total Number of Films | Wt. % Fabric Layers/Wt. % Films | Areal Density (lbs/sq. ft) |
|---|---|---|---|---|---|---|---|
| J-1 (Control) | B (16") | Aramid-1 | 24 | none | 0 | 100/0 | 1.61 |
| J-2 (Control) | B (16") | Aramid-2 | 14 | none | 0 | 100/0 | 1.58 |
| J-3 | B (16") | Aramid-2 | 10 | Coex-1 | 20 | 72/28 | 1.56 |
| J-5 | B (16") | Aramid-2 | 10 | Coex-1d | 20 | 72/28 | 1.56 |
| J-6 | B (16") | Aramid-2 | 10 | Coex-1e | 20 | 72/28 | 1.56 |
| J-7 | B (16") | Aramid-2 | 10 | Coex-3 | 22 | 72/28 | 1.56 |
| J-8 (Control) | B (16") | Aramid-4 | 12 | none | 0 | 100/0 | 1.28 |
| J-9 | B (16") | Aramid-4 | 10 | Coex-1 | 10 | 83/17 | 1.28 |
| J-10 | B (16") | Aramid-4 | 9 | Coex-1 | 15 | 75/25 | 1.28 |

No "J-4" sample was tested.

TABLE 6b

| Composite Assembly Sample | Wt. % Fabric Layers/Wt. % Films | Areal Density (lbs/sq. ft) | BFS average (mm) | Standard Deviation (mm) | Performance relative to Control | Elongational Strength Index of Films (psi) |
|---|---|---|---|---|---|---|
| J-1 (Control) | 100/0 | 1.61 | 45.0 | 5.4 (n = 4) | | |
| J-2 (Control) | 100/0 | 1.58 | 37.8 | 3.8 (n = 4) | | |
| J-3 | 72/28 | 1.56 | 26.5 | 2.6 (n = 4) | 30% BFS decrease to J-2 | 1495 |
| J-5 | 72/28 | 1.56 | 26.5 | 3.7 (n = 4) | 30% BFS decrease to J-2 | not measured |
| J-6 | 72/28 | 1.56 | 26.3 | 3.9 (n = 4) | 30% BFS decrease to J-2 | not measured |
| J-7 | 72/28 | 1.56 | 52.5 | 5.0 (n = 4) | 39% BFS increase to J-2 | 46 |
| J-8 (Control) | 100/0 | 1.28 | 33.5 | 5.1 (n = 4) | | |
| J-9 | 83/17 | 1.28 | 31.5 | 3.7 (n = 4) | 6% BFS decrease to J-8 | 1495 |
| J-10 | 75/25 | 1.28 | 32.3 | 2.9 (n = 3)* | 4% BFS decrease to J-8 (of those not perforating)* | 1495 |

*one bullet caused a perforating impact and was not included in calculations.

It was surprising and unexpected that the BFS average improved by the amount shown for samples J-3 through J-6 (relative the J-2 control) by incorporating the backing section of distinct films, even with the accompanying mass reduction for the amount of Aramid-4 ballistic fabric.

It was surprising and unexpected that the BFS average improved (decreased) by 50% for sample J-3 relative sample J-7 by incorporating the backing section of Coex-1 films (J-3) instead of the backing section of Coex-3 films (J-7), where the essential differences between Coex-1 and Coex-3 films was the lack of crosslinking and solid-state orientation in the Coex-3 film, shown by the resulting difference in the elongational strength indices for the films (1495 psi compared to 46 psi).

The J-3 through J-6 composite assemblies had essentially the same BFS average. The difference between these assemblies was the amount of electron-beam radiation to which the films of the backing section were exposed during manufacture. The electron-beam dosage amount varied from 40% lower (indicating a lower level of crosslinking) for the films of the backing sections of the J-5 assembly compared to that used for the films of the backing section of the J-3 assembly, to 20% higher (indicating a higher level of crosslinking) for the films of the backing sections of the J-6 assembly compared to that used for the films of the backing section of the J-3 assembly. Yet the resulting assemblies had similar BFS averages. Although not bound by this theory, Applicants theorize that this result, viewed in conjunction with the previous paragraph, indicates that the orientation amount has a greater effect on performance of the films to improve BFS performance than does the amount of crosslinking in the films.

It was surprising and unexpected that the BFS average was in essence the same for sample J-9 and J-10 (relative the J-8 control) by incorporating the backing section of distinct films, even with the accompanying mass reduction for the amount of penetration-resistant Aramid-4 fabric.

7. Target Set K

The target set K was tested in the same manner as target set H, except that the weapon used was a Ruger Super Blackhawk .44 Magnum pistol; and the average muzzle velocity was determined to be 1405 ft/sec with a standard deviation of 19 ft/sec. The configuration and composition of the composite samples, and BFS test results are shown below in Tables 7a and 7b.

As a "Type B" composite assembly (previously described in more detail), the K-1 composite assembly had a base section comprising all 10 of the ballistic fabric layers and a backing section comprising all 20 of the distinct films.

As a "Type C" composite assembly (previously described in more detail), the K-2 composite assembly had two sections: a first section of 5 ballistic fabric layers followed by 10 distinct films, and a second section of 5 ballistic fabric layers followed by 10 distinct films.

As a "Type D" composite assembly (previously described in more detail), the K-3 composite assembly had the ballistic fabric layers and the distinct films sequenced in 10 alternating repeating groups of one ballistic fabric layer toward the projectile strike side and two distinct films toward the protected side.

TABLE 7a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| K-1 | B (16") | Aramid-2 | 10 | Coex-1 | 20 | 72/28 | 1.56 |
| K-2 | C (16") | Aramid-2 | 10 | Coex-1 | 20 | 72/28 | 1.56 |
| K-3 | D (16") | Aramid-2 | 10 | Coex-1 | 20 | 72/28 | 1.56 |

TABLE 7b

| Composite Assembly Sample | Composite Assembly Type | Wt. % Fabric Layers/Wt. % Films | Areal Density (lbs/sq. ft) | BFS average (mm) | Standard Deviation (mm) | Performance relative to K-1 |
|---|---|---|---|---|---|---|
| K-1 | B | 72/28 | 1.56 | 30.8 | 6.7 (n = 4) | |
| K-2 | C | 72/28 | 1.56 | 29.8 | 4.5 (n = 4) | 3% BFS decrease |
| K-3 | D | 72/28 | 1.56 | 38.8 | 3.3 (n = 4) | 26% BFS increase |

The bullet strike areas on the K-3 composite assembly showed several of the foremost film layers were penetrated without any significant evidence of elongation around the bullet entry zone, and the BFS performance was 26% greater (worse) than that of the K-1 composite assembly. Accordingly, it is believed that performance is enhanced by configuring the ballistic fabric layers more toward the projectile strike side of the composite assembly and the films more toward the protected side of the composite assembly.

8. Target Set L

The target set L was tested in the same manner as target set H, except that the weapon used was a Ruger Super Blackhawk .44 Magnum pistol; and the average muzzle velocity was determined to be 1408 ft/sec with a standard deviation of 19 ft/sec. The configuration and composition of the composite samples, and BFS test results are shown below in Tables 8a and 8b.

TABLE 8a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| L-1 (Control) | B (16") | Aramid-2 | 14 | none | 0 | 100/0 | 1.58 |
| L-2 | B (16") | Aramid-2 | 10 | Coex-1 | 20 | 72/28 | 1.56 |
| L-3 | B (16") | Aramid-2 | 10 | Mono-2 | 32 | 72/28 | 1.56 |
| L-4 | B (16") | Aramid-2 | 10 | Coex-4 | 35 | 72/28 | 1.56 |
| L-5 | B (16") | Aramid-2 | 10 | Mono-3 | 30 | 72/28 | 1.57 |
| L-6 | B (16") | Aramid-2 | 10 | Mono-4 | 17 | 72/28 | 1.57 |
| L-7 | B (16") | Aramid-2 | 10 | Coex-2 | 43 | 72/28 | 1.56 |
| L-8 | B (16") | Aramid-2 | 10 | Mono-6 | 18 | 72/28 | 1.57 |
| L-9 | B (16") | Aramid-2 | 10 | Coex-1a | 16 | 73/27 | 1.56 |
| L-10 | B (16") | Aramid-2 | 10 | Mono-5 | 30 | 72/28 | 1.56 |

TABLE 8b

| Composite Assembly Sample | Wt. % Fabric Layers/Wt. % Films | Areal Density (lbs/sq. ft) | BFS average (mm) | Standard Deviation (mm) | Performance relative to Control | Elongational Strength Index of Film (psi) |
|---|---|---|---|---|---|---|
| L-1 (Control) | 100/0 | 1.58 | 40.5 | 6.6 (n = 4) | | |
| L-2 | 72/28 | 1.56 | 30.3 | 0.5 (n = 4) | 25% BFS decrease | 1495 |
| L-3 | 72/28 | 1.56 | 42.8 | 4.6 (n = 4) | 6% BFS increase | 252 |
| L-4 | 72/28 | 1.56 | 38.0 | 5.6 (n = 4) | 6% BFS decrease | 37 |
| L-5 | 72/28 | 1.57 | 38.3 | 4.6 (n = 4) | 6% BFS decrease | 724 |
| L-6 | 72/28 | 1.57 | 37.3 | 3.7 (n = 4) | 8% BFS decrease | 65 |
| L-7 | 72/28 | 1.56 | 29.5 | 0.6 (n = 4) | 27% BFS decrease | 1222 |
| L-8 | 72/28 | 1.57 | 39.0 | 4.8 (n = 4) | 4% BFS decrease | 145 |
| L-9 | 73/27 | 1.56 | 28.8 | 1.3 (n = 4) | 29% BFS decrease | not measured |
| L-10 | 72/28 | 1.56 | 40.5 | 3.4 (n = 4) | same BFS | 85 |

It was surprising and unexpected that the BFS average improved (decreased) by the amount shown for samples L-2, L-7, and L-9 (relative the L-1 control) by incorporating the backing section of films, even with the accompanying mass reduction for the amount of Aramid-2 ballistic fabric. It was also surprising and unexpected that the BFS averages for the L-2, L-7, and L-9 samples (having oriented polyolefin films with the relatively higher elongational strength indices of 1495 psi, 1222 psi, and not measured, respectively) improved (decreased) so much more relative the control than did the L-3, L4, L-5, L-6, and L-8 samples (having films with the relatively lower elongational strength indices of 252, 37, 724, 65, and 145 psi, respectively).

9. Target Set M

The target set M was tested by Oregon Ballistic Labs in accordance with NIJ standard 0101.06. The configuration and composition of the composite samples, and BFS test results are shown below in Tables 9a and 9b.

TABLE 9b

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| M-1 (Control) | A (15") | Olefin-1 | 33 | none | 0 | 100/0 | 1.20 |
| M-2 | A (15") | Olefin-1 | 27 | Coex-1 | 11 | 81/19 | 1.22 |

TABLE 9b

| Composite Assembly Sample | Wt. % Fabric Layers/Wt. % Films | Areal Density (lbs/sq. ft) | BFS average (mm) | Standard Deviation (mm) | Performance relative to Control |
|---|---|---|---|---|---|
| M-1 (Control) | 100/0 | 1.20 | 41.0 | 1.1 (n = 3) | |
| M-2 | 81/19 | 1.22 | 40.5 | 0.9 (n = 3) | 1% BFS decrease |

10. Target Set N

The target set N was tested in the same manner as target set M. The configuration and composition of the composite samples, and BFS test results are shown below in Tables 10a and 10b.

TABLE 10a

| Composite Assembly Sample | Composite Assembly Type/ Length of square side (inches) | Fabric Layer Composition | Total Number of Fabric Layers | Film Layer Composition | Total Number of Film Layer | Wt. % Fabric Layers/Wt. % Film Layers | Areal Density (lbs/sq. ft) |
|---|---|---|---|---|---|---|---|
| N-1 (Control) | B (16") | Aramid-4 | 12 | none | 0 | 100/0 | 1.28 |
| N-2 | B (16") | Aramid-4 | 10 | Coex-1 | 10 | 83/17 | 1.28 |

TABLE 10b

| Composite Assembly Sample | Wt. % Fabric Layers/ Wt. % Films Layers | Areal Density (lbs/sq. ft) | BFS average (mm) | Standard Deviation (mm) | Performance relative to Control |
|---|---|---|---|---|---|
| N-1 (Control) | 100/0 | 1.28 | 38.6 | 1.0 (n = 3) | |
| N-2 | 83/17 | 1.28 | 39.9 | 1.0 (n = 3) | 3% BFS increase |

11. Ballistic Limit (V50) Testing

The following composite assemblies were tested for back-face signature and ballistic limit (estimated velocity at which 50% of the bullets would penetrate the target). The configuration and composition of the composite samples, BFS test results, and V50 test results are shown below in Tables 11a and 11b.

TABLE 11a

| Composite Assembly Sample | Composite Assembly Type/ Length of square side (inches) | Ballistic Fabric Layer Composition | Total Number of Ballistic Fabric Layers | Film Composition | Total Number of Films | Wt. % Fabric Layers/Wt. % Films | Areal Density (lbs/sq. ft) |
|---|---|---|---|---|---|---|---|
| G-1 (Control) | A (17") | Aramid-1 | 24 | none | 0 | 100/0 | 1.61 |
| G-2 | A (17") | Aramid-1 | 11 | Coex-1 | 19 | 65/35 | 1.13 |
| G-3 | A (17") | Aramid-1 | 12 | Coex-1 | 38 | 50/50 | 1.62 |
| G-4 | A (17") | Aramid-1 | 18 | Coex-1 | 19 | 75/25 | 1.61 |
| G-5 | A (17") | Aramid-1 | 18 | Coex-1b | 19 | 75/25 | 1.63 |

TABLE 11b

| Composite Assembly Sample | Wt. % Fabric Layers/Wt. % Films | Areal Density (lbs/sq. ft) | Weapon | BFS average (mm) | Standard Deviation (mm) | V50 (ft/sec) | Performance relative to Control |
|---|---|---|---|---|---|---|---|
| G-1 (Control) | 100/0 | 1.61 | .357 SIG | | | 1845 | |
| | | | .44 Magnum* | 43.1 | 1.9 | | |
| G-2 | 65/35 | 1.13 | .357 SIG | | | 1429 | 23% V50 decrease |
| G-3 | 50/50 | 1.62 | .357 SIG | | | 1522 | 18% V50 decrease |
| G-4 | 75/25 | 1.61 | .357 SIG | | | 1781 | 3% V50 decrease |
| | | | .44 Magnum* | 34.6 | 0.9 | | 20% BFS decrease |
| | | | | 33.3 | 1.0 | | 23% BFS decrease |
| G-5 | 75/25 | 1.63 | .357 SIG | | | 1732 | 6% V50 decrease |

*1400 ft/sec muzzle velocity

It was surprising and unexpected that the US average improved (decreased) by the amount shown for sample G-4 relative the G-1 control by incorporating the backing section of films, even with the accompanying mass reduction for the amount of ballistic fabric.

The results show the greatest deterioration in V50 with G-2, which has the lowest areal density. The G-3 through G-5 samples also show a deterioration of the V50 relative the control; however, a relatively low deterioration (i.e., 3% or 6%) occurs when the weight of Aramid-1 ballistic fabric in the base section of the composite assembly was reduced by 25% (G-4 and G-5).

The difference between the G-4 and the G-5 composite assemblies was the nature of the backing section films of the composite assembly. The G-4 films were not annealed; and the G-5 backing films were annealed. The similar ballistic limit V50 performance of G-4 and G-5 assemblies indicates that the annealing of the films did not significantly affect the V50 performance.

VIII. Various Embodiments

Various and additional embodiments of the disclosed subject matter are described and recited in the following sentences A through KK.

A. A composite assembly useful for resisting the penetration of projectiles, the composite assembly comprising:

a plurality of ballistic fabric layers; and a plurality of distinct films adjacent the plurality of ballistic fabric layers, wherein each distinct film of the plurality of distinct films comprises thermoplastic polymer and has an elongational strength index of at least 800 psi, where the elongational strength index is calculated by the following formula:

$$ESI=(SM)^2/(ITM)$$

wherein ESI is the elongational strength index, SM is the lower of the secant moduli at 125% elongation in units of psi measured in the longitudinal and transverse directions, and ITM is the initial tensile modulus in units of psi measured in the direction having the lower of the secant moduli at 125% elongation.

B. A composite assembly useful for resisting the penetration of projectiles, the composite assembly comprising:

a plurality of ballistic fabric layers; and a plurality of distinct films adjacent the plurality of ballistic fabric layers, wherein each distinct film of the plurality of distinct films comprises polyolefin and has a birefringence of at least $5\times10^{-3}$.

C. A composite assembly useful for resisting the penetration of projectiles, the composite assembly comprising:

a plurality of ballistic fabric layers; and a plurality of distinct films adjacent the plurality of ballistic fabric layers, wherein each distinct film of the plurality of distinct films comprises polyolefin and has a crystallinity of from 20% to 50%.

D. A composite assembly useful for resisting the penetration of projectiles, the composite assembly comprising:

a plurality of ballistic fabric layers; and a plurality of distinct films adjacent the plurality of ballistic fabric layers, wherein each distinct film of the plurality of distinct films has:

a secant modulus at 125% elongation of at least 6,000 psi measured in the direction of longitudinal or transverse having the lower of the secant moduli at 125% elongation; and an initial tensile modulus of at most 400,000 psi, measured in the same direction as that having the lower of the secant moduli at 125% elongation.

E. The composite assembly of any one of the preceding sentences wherein the ballistic fabrics of the plurality of ballistic fabric layers comprise yarns comprising one or more polymers selected from aramid and ultra high molecular weight polyethylene.

F. The composite assembly of any one of the preceding sentences wherein the ballistic fabrics of the plurality of ballistic fabric layers comprise yarns comprising one or more polymers selected from polyamide, polyolefin, polyvinyl alcohol, polyacrylonitrile, and polyazoles.

G. The composite assembly of any one of the preceding sentences wherein the ballistic fabrics of the plurality of ballistic fabric layers comprise yarns comprising one or more of liquid crystal copolyester, glass, and carbon fibers.

H. The composite assembly of any one of the preceding sentences wherein the ballistic fabrics of the plurality of ballistic fabric layers are selected from one or more of woven ballistic fabrics and consolidated ballistic fabrics.

I. The composite assembly of any one of the preceding sentences wherein each distinct film of the plurality of distinct films has an elongational strength index of at least any one of the following: 800, 850, 900, 950, 1000, 1050, 1100, 1150, 1200, 1250, 1300, 1350, 1400, 1450, and 1500 psi.

J. The composite assembly of any one of the preceding sentences wherein each distinct film comprises at least any one of 50, 60, 70, 80, 90, and 95% polyolefin by weight of the distinct film.

K. The composite assembly of any one of the preceding sentences wherein each distinct film comprises at least any one of 50, 60, 70, 80, 90, and 95% by weight of the distinct film of any one of polyamide, polyester, and vinyl plastic.

L. The composite assembly of any one of the preceding sentences wherein each distinct film comprises at least any one of 50, 60, 70, 80, 90, and 95% by weight of the distinct film of any one of ionomer, polyethylene, polypropylene, and ethylene/vinyl alcohol copolymer.

M. The composite assembly of any one of the preceding sentences wherein each distinct films of the plurality of distinct films has a birefringence of at least any one of $5\times10^{-3}$, $6\times10^{-3}$, $7\times10^{-3}$, $8\times10^{-3}$, $9\times10^{-3}$, $10\times10^{--3}$, and $11\times10^{-3}$.

N. The composite assembly of any one of the preceding sentences wherein each of the distinct films of the plurality of distinct films has a crystallinity of from 20% to 50%.

O. The composite assembly of any one of the preceding sentences wherein each of the distinct films of the plurality of distinct films is oriented, for example, in at least one direction or in at least both the longitudinal and transverse directions, by at least one of any of the following ratios: 1.5:1, 2:1, 2.5:1, 3:1, 3.5:1, 4:1, 5:1, 6:1, 7:1, 8:1, 9:1, 10:1, 12:1, and 15:1.

P. The composite assembly of any one of the preceding sentences wherein each distinct film of the plurality of distinct films has a thickness of at most any one of 30 mils, 20 mils, 10 mils, 5 mils, 4 mils, 3 mils, 2 mils, 1.5 mils, 1.2 mils, and 1 mil, and a thickness of at least any one of 0.25 mils, 0.3 mils, 0.35 mils, 0.4 mils, 0.45 mils, 0.5 mils, 0.6 mils, 0.75 mils, 0.8 mils, 0.9 mils, 1 mil, 1.2 mils, 1.4 mils, 1.5 mils, 2 mils, 3 mils, and 5 mils.

Q. The composite assembly of any one of the preceding sentences wherein the plurality of distinct films comprises at least any one of 5, 6, 7, 8, 9, 10, 12, 15, 20, 25, 30, 35, 40, 45, 50, 60, 70, 80, 90, and 100 distinct films.

R. The composite assembly of any one of the preceding sentences wherein the plurality of distinct films comprises at most any one of 5, 6, 7, 8, 9, 10, 12, 15, 20, 25, 30, 35, 40, 45, 50, 60, 70, 80, 90, and 100 distinct films.

S. The composite assembly of any one of the preceding sentences wherein each distinct film of the plurality of distinct films comprises at least any one of the following numbers of layers: 1, 2, 3, 4, 5, 6, 7, 8, 9, 10, 11, 13, and 15.

T. The composite assembly of any one of the preceding sentences wherein each distinct film of the plurality of distinct films comprises at most any one of the following numbers of layers: 1, 2, 3, 4, 5, 6, 7, 8, 9, 10, 11, 13, and 15.

U. The composite assembly of any one of the preceding sentences wherein:

the composite assembly has a strike side and an opposite protected side;

the composite assembly has a total weight comprising the sum of the weights of the plurality of ballistic fabric layers and the plurality of distinct films; and at least any one of 60%, 70%, 80%, 90%, and 95% of the total weight of the plurality of distinct films is located within a region extending for a distance from the protected side of the composite assembly corresponding to 50% of the total weight of the composite assembly.

V. The composite assembly of any one of the preceding sentences having a total areal density of at least any one of 0.8, 0.9, 1.0, 1.1 1.2, 1.4, 1.6, 1.8, 2.0, 2.2, and 2.4 pounds per square foot, and/or at most any one of 0.9, 1.0, 1.1 1.2, 1.4, 1.6, 1.8, 2.0, 2.2, 2.4, and 2.5 pounds per square foot, based on the sum of the areal densities of the plurality of ballistic fabrics and the plurality of distinct films.

W. The composite assembly of any one of the preceding sentences wherein the plurality of ballistic fabric layers comprises at least, and/or at most, any one of 5, 6, 7, 8, 9, 10, 12, 15, 20, 25, 30, and 40 ballistic fabric layers.

X. The composite assembly of any one of the preceding sentences comprising at least any one of 10, 15, 20, 30, 35, 40, 45, 50, and 55 weight parts, and/or at most any one of 60, 55, 50, 45, 40, 35, 30, 25, 20, 15 weight parts, plurality of distinct films relative 100 weight parts of the combination of plurality of distinct films and the plurality of ballistic fabric layers.

Y. The composite assembly of any one of the preceding sentences wherein the plurality of ballistic fabric layers are in a stacked arrangement.

Z. The composite assembly of any one of the preceding sentences wherein each one of at least any one of 60%, 65%, 70%, 75%, 80%, 85%, 90%, and 95% of the number of ballistic fabric layers of the plurality of fabric layers is directly adjacent at least two other fabric layers of the plurality of ballistic fabric layers.

AA. The composite assembly of any one of the preceding sentences wherein the plurality of distinct films are in a stacked arrangement.

BB. The composite assembly of any one of the preceding sentences wherein each one of at least any one of 60%, 65%, 70%, 75%, 80%, 85%, 90%, and 95% of the number of distinct films of the plurality of distinct films is directly adjacent at least two other films of the plurality of distinct films.

CC. The composite assembly of any one of the preceding sentences wherein a distinct film of the plurality of distinct films comprises the protected side of the composite assembly.

DD. The composite assembly of any one of the preceding sentences wherein a ballistic fabric layer of the plurality of ballistic fabric layers comprises the strike side of the composite assembly.

EE. The composite assembly of any one of the preceding sentences wherein each ballistic fabric layer of the plurality of ballistic fabric layers comprises at least any one of 50%, 60%, 70%, and 80% by weight of the ballistic fabric of yarns having a tenacity of at least any one of 7, 8, 10, 11, 15, 16, 20, 22, 25, 28, and 30 grams per denier.

FF. The composite assembly of any one of the preceding sentences wherein each ballistic fabric layer of the plurality of ballistic fabric layers comprises at least any one of 50%, 60%, 70%, and 80% by weight of the ballistic fabric of yarns having a tenacity of at least any one of 7, 8, 10, 11, 15, 16, 20, 22, 25, 28, and 30 grams per denier.

GG. The composite assembly of any one of the preceding sentences wherein each ballistic fabric layer of the plurality of ballistic fabric layers comprises at least any one of 50%, 60%, 70%, and 80% by weight of the ballistic fabric of yarns having an initial tensile modulus of at least any one of 100, 150, 200, 300, 400, 500, 900, 1000, and 1200 grams per denier.

HH. The composite assembly of any one of the preceding sentences wherein each distinct film of the plurality of distinct films has a secant modulus at 125% elongation (taken as the lower value of the longitudinal and transverse directions) of at least 7,000 psi and an initial tensile modulus (in the same direction as the secant modulus measurement) of at most 100,000 psi.

II. The composite assembly of any one of the preceding sentences wherein each distinct film of the plurality of distinct films has an initial tensile modulus (in either or both of the longitudinal and transverse directions) of at least, and/or at most, any one of the following: 10,000; 15,000; 20,000; 25,000; 30,000; 40,000; 70,000; 80,000; 90,000; 100,000; 150,000; 200,000; 250,000; 300,000; 350,000; and 400,000 pounds/square inch.

JJ. The composite assembly of any one of the preceding sentences wherein each distinct film of the plurality of distinct films has a secant modulus at 125% elongation (in either or both of the longitudinal and transverse directions) of at least, and/or at most, any one of the following: 1,000; 3,000; 4,000; 5,000; 6,000; 7,000; 8,000; 9,000; 10,000; 12,000; 15,000; 20,000; 25,000; 30,000; and 40,000 pounds/square inch (psi).

KK. A body armor article comprising the composite assembly of any one of the preceding sentences.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A composite assembly useful for resisting the penetration of projectiles, the composite assembly comprising:

a plurality of ballistic fabric layers; and a plurality of distinct films adjacent the plurality of ballistic fabric layers, wherein each distinct film of the plurality of distinct films (i) comprises polyolefin, (ii) has a birefringence of at least $5\times10^{-3}$, and (iii) has an elongational strength index of at least 800 psi, where the elongational strength index is calculated by the following formula:

$$ESI=(SM)^2/(ITM)$$

wherein ESI is the elongational strength index, SM is the lower of the secant moduli at 125% elongation in units of psi measured in the longitudinal and transverse directions, and ITM is the initial tensile modulus in units of psi measured in the direction having the lower of the secant moduli at 125% elongation;

wherein each distinct film of the plurality of distinct films (a) is attached to another of the plurality of distinct films by less than 80% of the coextensive surface area or (b) is unsecured to another of the plurality of distinct films;

wherein the composite assembly has a strike side and an opposite protected side, the composite assembly having a total weight comprising the sum of the weights of the plurality of ballistic fabric layers and the plurality of distinct films; and wherein:

(i) at least 60% of the total weight of the plurality of distinct films is located within a region extending for a distance from the protected side of the composite assembly corresponding to 50% of the total weight of the composite assembly; or (ii) each one of at least 60% of the number of distinct films of the plurality of distinct films is directly adjacent at least two other distinct films of the plurality of distinct films.

2. The composite assembly of claim 1 wherein the ballistic fabrics of the plurality of ballistic fabric layers comprise yarns comprising one or more polymers selected from aramid and ultra high molecular weight polyethylene.

3. The composite assembly of claim 1 wherein the ballistic fabrics of the plurality of ballistic fabric layers are selected from one or more of woven ballistic fabrics and consolidated ballistic fabrics.

4. The composite assembly of claim 1 wherein each distinct film of the plurality of distinct films has an elongational strength index of at least 1,000 psi.

5. The composite assembly of claim 1 wherein each distinct film of the plurality of distinct films has:

a secant modulus at 125% elongation of at least 6,000 psi measured in the direction of longitudinal or transverse having the lower of the secant moduli at 125% elongation; and an initial tensile modulus of at most 400,000 psi, measured in the same direction as that having the lower of the secant moduli at 125% elongation.

6. The composite assembly of claim 1 wherein each distinct film comprises at least 50% polyolefin by weight of the distinct film.

7. The composite assembly of claim 1 wherein each of the distinct films of the plurality of distinct films has a crystallinity of from 20% to 50%.

8. The composite assembly of claim 1 wherein each of the distinct films of the plurality of distinct films is oriented.

9. The composite assembly of claim 1 wherein each distinct film of the plurality of distinct films has a thickness of at most 30 mils.

10. The composite assembly of claim 1 wherein the plurality of distinct films comprises at least 5 distinct films each having a thickness of at least 0.5 mils.

11. The composite assembly of claim 1 wherein each distinct film of the plurality of distinct films comprises at least 2 layers.

12. The composite assembly of claim 1 wherein and at least 60% of the total weight of the plurality of distinct films is located within a region extending for a distance from the protected side of the composite assembly corresponding to 50% of the total weight of the composite assembly.

13. The composite assembly of claim 12 wherein at least 70% of the total weight of the plurality of distinct films is located within a region extending for a distance from the protected side of the composite assembly corresponding to 50% of the total weight of the composite assembly.

14. The composite assembly of claim 1 having a total areal density of at least 0.8 pounds per square foot based on the sum of the areal densities of the plurality of ballistic fabrics and the plurality of distinct films.

15. The composite assembly of claim 1 having a total areal density of at most 2.0 pounds per square foot based on the sum of the areal densities of the plurality of ballistic fabrics and the plurality of distinct films.

16. The composite assembly of claim 1 comprising at least 10 weight parts plurality of distinct films relative 100 weight parts of the combination of plurality of distinct films and the plurality of ballistic fabric layers.

17. The composite assembly of claim 1 comprising at most 60 weight parts plurality of distinct films relative 100 weight parts of the combination of plurality of distinct films and the plurality of ballistic fabric layers.

18. The composite assembly of claim 1 wherein the plurality of ballistic fabric layers are in a stacked arrangement.

19. The composite assembly of claim 1 wherein each one of at least 60% of the number of ballistic fabric layers of the plurality of fabric layers is directly adjacent at least two other fabric layers of the plurality of ballistic fabric layers.

20. The composite assembly of claim 1 wherein the plurality of distinct films are in a stacked arrangement.

21. The composite assembly of claim 1 wherein each one of at least 60% of the number of distinct films of the plurality of distinct films is directly adjacent at least two other distinct films of the plurality of distinct films.

22. The composite assembly of claim 1 wherein a distinct film of the plurality of distinct films comprises the protected side of the composite assembly and a ballistic fabric layer of the plurality of ballistic fabric layers comprises the strike side of the composite assembly.

23. A body armor article comprising the composite assembly of claim 1.

* * * * *